United States Patent [19]

Takamuki et al.

[11] Patent Number: 5,045,441

[45] Date of Patent: Sep. 3, 1991

[54] SILVER HALIDE PHOTOGRAPHIC LIGHT-SENSITIVE MATERIAL INHIBITED IN PRODUCING PIN-HOLES

[75] Inventors: Yasuhiko Takamuki; Takeshi Habu, both of Hachioji, Japan

[73] Assignee: Konica Corporation, Tokyo, Japan

[21] Appl. No.: 481,632

[22] Filed: Feb. 20, 1990

[30] Foreign Application Priority Data

Feb. 23, 1989 [JP] Japan ..... 61-44107

[51] Int. Cl.[5] ..... G03C 1/35

[52] U.S. Cl. ..... 430/529; 430/527; 430/624

[58] Field of Search ..... 430/529, 527, 624

[56] References Cited

U.S. PATENT DOCUMENTS

| | | | |
|---|---|---|---|
| 3,791,831 | 2/1974 | von Bonin et al. | 430/529 |
| 3,861,924 | 1/1975 | Mackey et al. . | |
| 3,963,498 | 6/1976 | Trevoy . | |
| 4,147,550 | 4/1979 | Campbell et al. | 430/529 |
| 4,225,665 | 9/1980 | Schadt, III | 430/529 |
| 4,245,036 | 1/1981 | De Winter et al. | 430/529 |
| 4,388,402 | 1/1983 | Mukunoki et al. | 430/529 |
| 4,585,730 | 4/1986 | Cho | 430/529 |
| 4,895,791 | 1/1990 | Mukunoki et al. | 430/529 |
| 4,908,155 | 3/1990 | Leemans et al. | 430/529 |
| 4,916,011 | 4/1990 | Miller | 430/529 |

OTHER PUBLICATIONS

Research Disclosure, No. 162, Oct. 1977, Emsworth, Hants, England, G. A. Campbell et al., "Sulfonated Anionic Microgel Latices Useful as Antistatic Agents", pp. 47–49.

*Primary Examiner*—Jack P. Brammer

*Attorney, Agent, or Firm*—Finnegan, Henderson, Farabow, Garrett and Dunner

[57] ABSTRACT

A silver halide photographic light-sensitive material is disclosed, which is inhibited in forming pin-holes in a phgotomechanical processes. The light-sensitive material comprises a support on a surface of which an electric conductive layer is provided. The electric conductive layer comprises a polymer having an aromatic ring or a heterocyclic ring each having a sulfonic acid group or a salt bonding to the aromatic or heterocyclic ring directly or through a divalent group, and a latex. This layer has a swelling degree of from 0.2 percent to 300 percent.

12 Claims, 2 Drawing Sheets

SILVER HALIDE PHOTOGRAPHIC LIGHT-SENSITIVE MATERIAL INHIBITED IN PRODUCING PIN-HOLES

FIELD OF THE INVENTION

This invention relates to a silver halide photographic light-sensitive material and particularly to a photographing light-sensitive material, a scanner light-sensitive material, a contact light-sensitive material and a facsimile light-sensitive material each applicable to graphic arts fields.

BACKGROUND OF THE INVENTION

Silver halide photographic light-sensitive materials used in recent graphic arts fields are liable to be statically charged in handling them. Particularly, in dried conditions such as winter time, they are statically charged up to several KV so as to make dusts readily adhere to them. This has causes pin-holes. The term, 'pin-hole', herein means a phenomenon that white clear spots of several to hundreds μm in size are produced in a blackened image. These spots are so named, because their shapes are circular or amorphous as if they were like pin-holes. An image having pin-holes must be remedied by stopping them, that is, so-called opaqueing. This has made operation efficiency seriously troublesome. From the viewpoint of the above-mentioned present situations, it has been strongly demanded to provide a light-sensitive material hardly producing pin-holes.

To meet this demand, some attempts were made to provide the methods in which silver halide photographic light-sensitive materials are improved by controlling the photographic characteristics. For example, one method is that pin-hole portions are diminished by increasing the density of a blackened image; another method is that pin-hole portions are diminished by making an adjacency development effect greater, that is, by inducing image spreading effect, with using a development accelerator; and a further method is that the wavelength of an exposure light-source is selected to use, thereby giving the light-source an illumination intensity on the longer wavelength side where pin-holes are hardly produced.

However, the method in which a developability is controlled has had a defect that the reproducibility of an image is damaged by softening image contrasts or producing fogs, though pin-holes may be diminished; and the selection of the wavelength of a light-source from the longer wave length side leads to the operability deterioration from the viewpoint of safe-light sensitivity, that is not preferable.

Based on the idea that it would be rather better that dust adhesion is to be reduced to diminish pin-holes caused by dust adhesion, than that photographic characteristics are to be improved to diminish them, there have been studies on the methods for preventing static by giving electric conductivity for example providing a electro-conductive layer to a silver halide photographic light-sensitive material.

However, a silver halide photographic light-sensitive material is processed in aqueous alkali and acid solutions each having an effect of eliminating the antistatic effect. To try to keep the antistatic effect, a conductive layer was made waterproof or was coated thereon by a waterproof layer so that the effect may not be eliminated even after the development is made. However, when a backing layer was coated the back side of graphic arts light-sensitive material having a gelatin-containing emulsion layer, or when a protective layer was further coated on the backing layer, the effect of the electric conductive layer was not displayed at all. The actual situations are as mentioned above.

SUMMARY OF THE INVENTION

An object of the invention to provide a silver halide photographic light-sensitive material which does not produce any pin-hole caused by making dusts adhere thereto, when exposing the light-sensitive material to variously selected light-source, in other words, when carrying out a camera work, scanner work or printer work.

Another object of the invention is to provide a silver halide photographic light-sensitive material excellent in various graphic arts characteristics such as line reproduction characteristics, halftone-dot qualities.

The above objects of the invention are accomplished by a silver halide photographic light-sensitive material comprising a support having on a surface thereof an electric conductive layer which comprises a polymer having an aromatic ring or a heterocyclic ring each having a sulfonic acid group or its salt bonding to the aromatic or heterocyclic ring directly or through a divalent group; and a latex, and has a swelling degree of from 0.2 percent to 300 percent; and a silver halide emulsion layer.

Hereinafter, the above-mentioned electric conductive layer and polymer having a sulfonic acid group or its salt are referred to conductive layer and conductive polymer, respectively.

BRIEF DESCRIPTION OF THE DRAWINGS

FIGS. 1 to 3 are a cross-sectional view of the layer arrangements of the silver halide photographic light-sensitive materials relating to the invention, wherein

1: Emulsion protective layer,
2: Emulsion layer,
3, 7: Conductive layers,
4, 6: Under-coat layers,
5: Support,
8: Backing layer
9: Backing protective layer, and
10: Adhesive layer

DETAILED DESCRIPTION OF THE INVENTION

Figure 1:
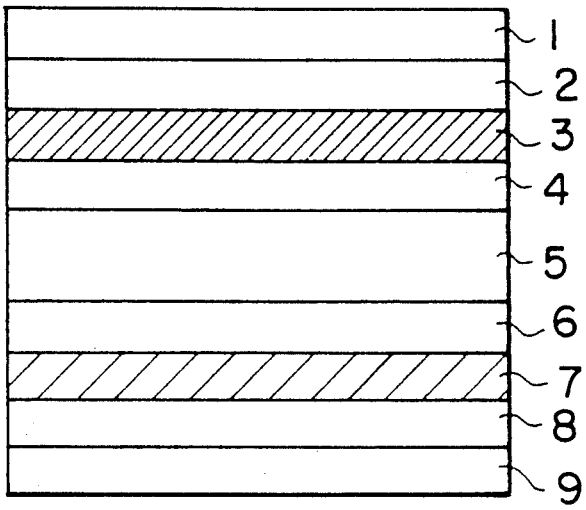
Figure 2:
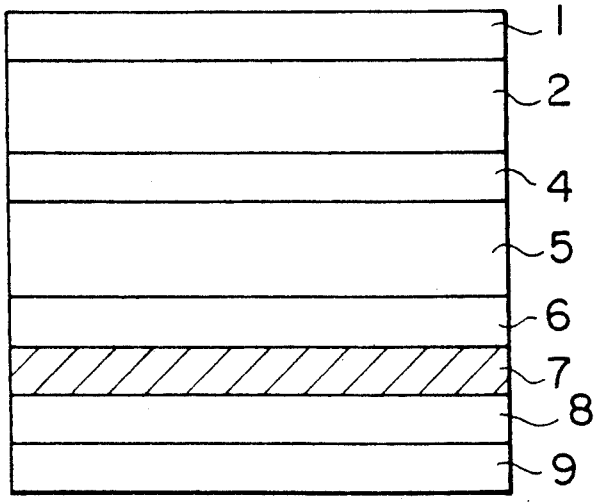
Figure 3:
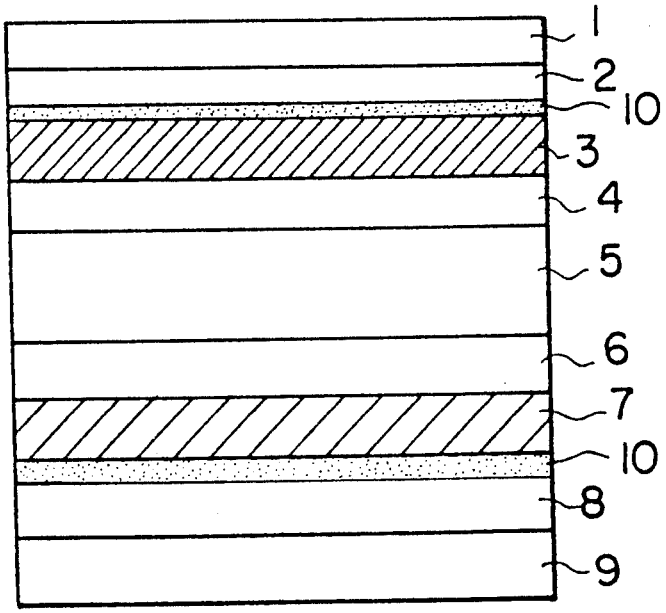

The light-sensitive materials of the invention may include various layer constructions such as for example, displayed in FIGS. 1 to 3.

FIG. 1 shows the cross-sectional views of the constitution of the invention. FIG. 1 shows an example that electric conductive layers are arranged to both of the emulsion side and backing side, respectively; FIG. 2 shows an example that a conductive layer is arranged only to the backing side; and FIG. 3 shows an example that adhesive layers are interposed between an emulsion layer and a conductive layer and between a backing layer and another conductive layer, respectively.

In this invention, the expression, 'a layer arranged above a certain layer' means that a layer is arranged farther from a support and, the expression, 'a layer arranged below a certain layer' means, on the contrary, that a layer is arranged closer to a support.

The conductive polymers applicable to the conductive layer of the invention are the compounds each having a molecular weight of 1000 to 1 million and particularly 10 thousand to a half million, which have an aromatic ring or a heterocycle each having a sulfonic acid group or the salt thereof directly or through a divalent coupling group on it. The aromatic and heterocyclic ring should preferably be a benzene ring and pyridine ring, respectively. Such polymers may readily be synthesized by polymerizing monomers each available on the market or obtainable in an ordinary method.

The conductivity of the conductive polymers of the invention has such a characteristic that the specific resistance may be not more than $10^{10}\Omega$/cm at 23° C., 20%RH on the surface of a conductive layer singly coated in a coating ratio of not more than 2 g/m$^2$, on a polyethyleneterephthalate film.

Some of the typical conductive polymers will be exemplified below:

P-1

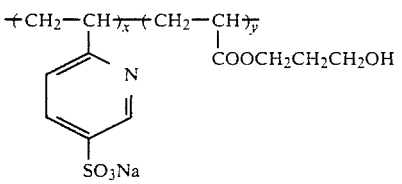

x:y = 70:30
$\overline{M} \approx$ 20,000

P-2

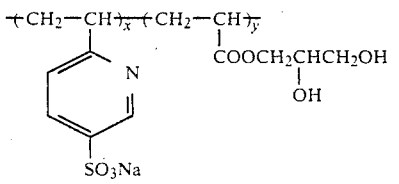

x:y = 70:30
$\overline{M} \approx$ 700,000

P-3

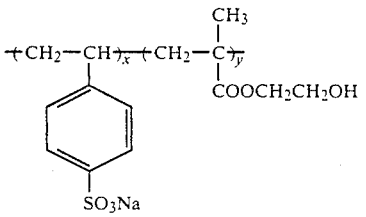

x:y = 70:30
$\overline{M} \approx$ 10,000

P-4

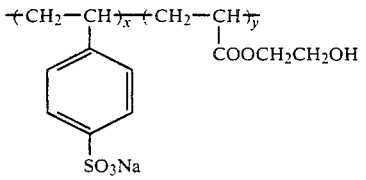

x:y = 70:30
$\overline{M} \approx$ 5,000

P-5

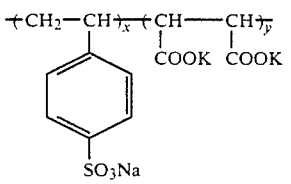

x:y = 50:50
$\overline{M} \approx$ 6,000

-continued

P-6

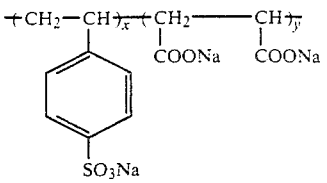

x:y = 65:35
$\overline{M} \approx$ 120,000

P-7

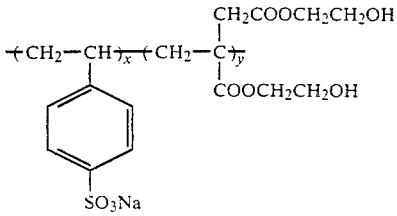

x:y = 98:2
$\overline{M} \approx$ 200,000

P-8

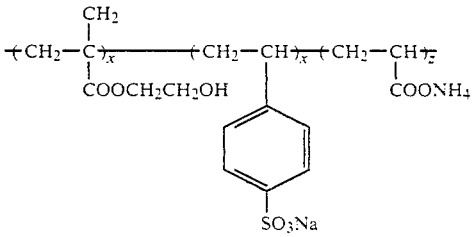

x:y:z = 40:30:1
$\overline{M} \approx$ 750,000

P-9

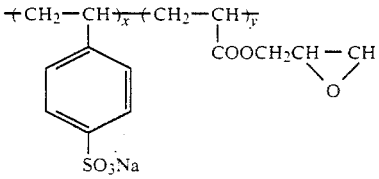

x:y = 70:30
$\overline{M} \approx$ 20,000

P-10

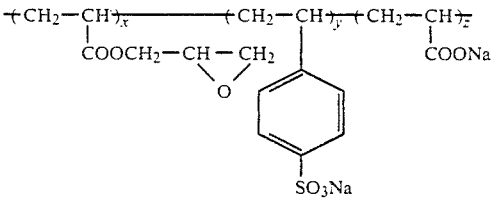

x:y:x = 85:13:2
$\overline{M} \approx$ 800,000

P-11

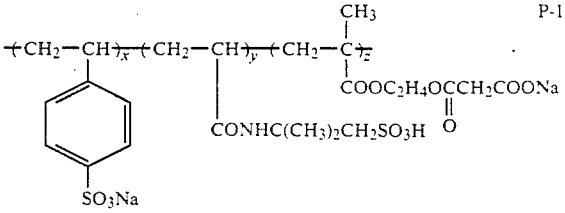

x:y:z = 88:19:3
$\overline{M} \approx$ 900,000

-continued

P-12

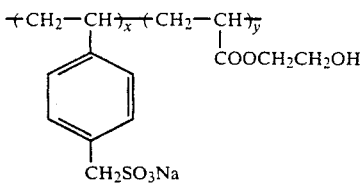

x:y = 80:20

$\overline{M} \approx 1000,000$

P-13

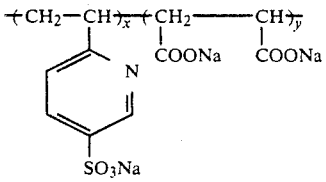

$\overline{M} \approx 10,000$ x:y = 80:20

P-14

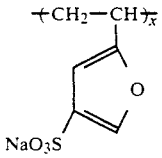

$\overline{M} \approx 200,000$

P-15

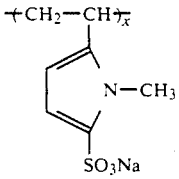

$\overline{M} \approx 200,000$

P-16

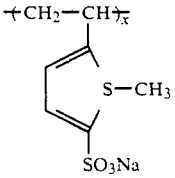

$\overline{M} \approx 150,000$

P-17

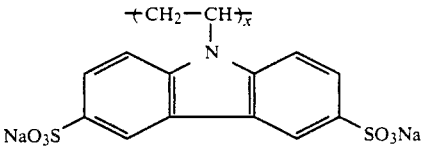

$\overline{M} \approx 150,000$

P-18

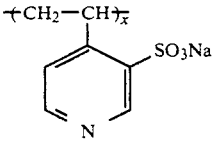

$\overline{M} \approx 280,000$

P-19

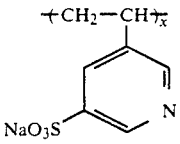

-continued $\overline{M} \approx 450,000$

P-20

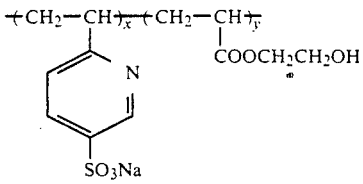

x:y = 60:40

$\overline{M} \approx 800,000$

P-21

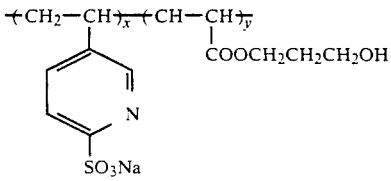

x:y = 70:

$\overline{M} \approx 650,000$

P-22

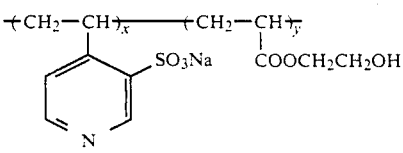

x:y = 80:20

$\overline{M} \approx 500,000$

P-23

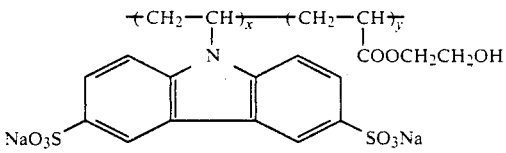

x:y = 75:25

$\overline{M} \approx 400,000$

P-24

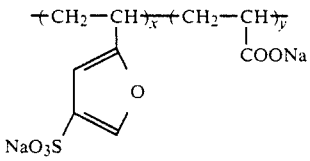

x:y = 80:20

$\overline{M} \approx 600,000$

P-25

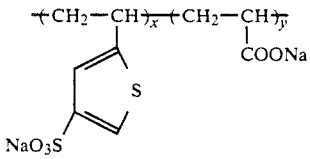

x:y = 90:10

$\overline{M} \approx 400,000$

P-26

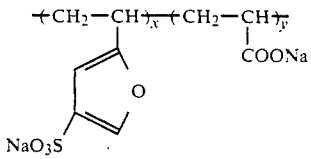

x:y = 54:45

$\overline{M} \approx 320,000$

-continued

P-27

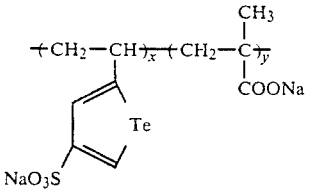

x:y = 90:10

$\overline{M} \approx 600,000$

P-28

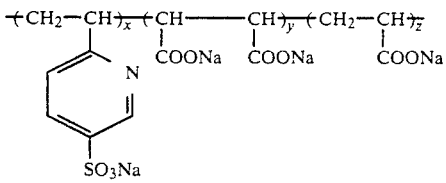

x:y:z = 80:10:10

$\overline{M} \approx 800,000$

P-29

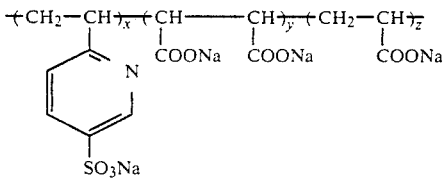

x:y = 70:30

$\overline{M} \approx 10,000$

P-30

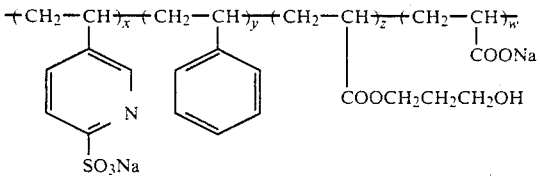

x:y:z:w = 60:30:8:2

$\overline{M} \approx 800,000$

P-31

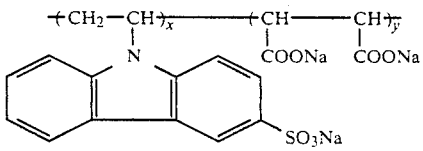

x:y = 60:40

$\overline{M} \approx 30,000$

P-32

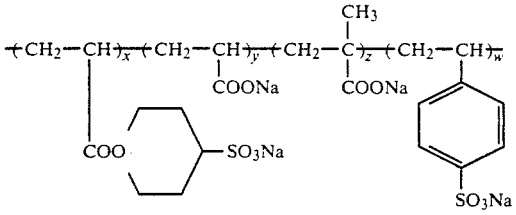

x:y:z:w = 40:30:20:10

$\overline{M} \approx 500,000$

P-33

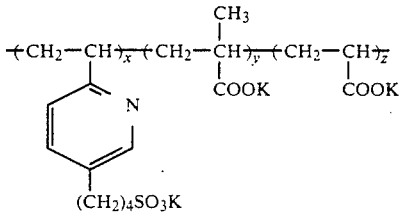

x:y:z = 60:30:10

$\overline{M} \approx 300,000$

-continued

P-34

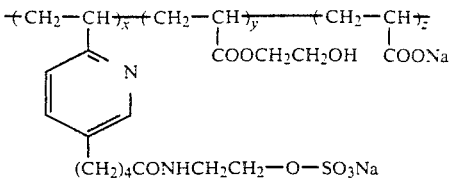

x:y:z = 40:30:30

$\overline{M} \approx 500,000$

P-35

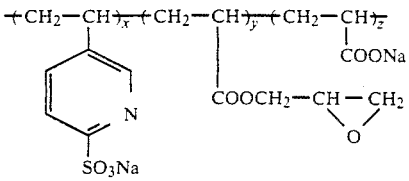

x:y:z = 55:35:10

$\overline{M} \approx 300,000$

P-36

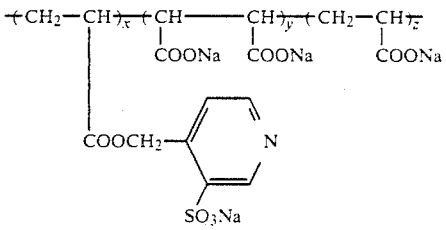

x:y:z = 50:30:20

$\overline{M} \approx 600,000$

P-37

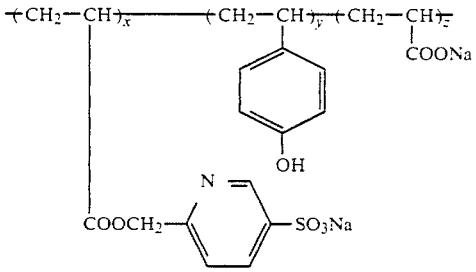

x:y:z = 60:30:10

$\overline{M} \approx 600,000$

In the above P-1 through P-37, x,y,z represent each a mol % of the respective monomer components; and $\overline{M}$ represents an average molecular weight. In this specification, an average molecular weight means a number average molecular weight.

The most useful polymers for embodying the invention are, generally, those having an average molecular weight of about a thousand to about a million, as mentioned above.

In the silver halide photographic light-sensitive materials of the invention, the conductive polymer should be added into the conductive layer thereof in an amount of 0.001 g to 10 g per $m^2$ in terms of the solid matter and, particularly, 0.05 g to 5 g.

The conductive polymer may be further added into in a backing layer, backing protective lay or silver halide emulsion layer.

When using such a conductive polymer in these layers, it is preferred to add in an amount of 0.01 to 10 g in terms of a solid matter.

The conductive layer of the invention should contain a latex together with the above-mentioned conductive polymer.

Such latexes applicable to the invention are preferably contain, in the polymer molecules thereof, an acrylate component or methacrylate component esterified with an alkyl group having 2 to 6 carbon atoms. Such components include, for example, methyl acrylate, ethyl acrylate, butyl acrylate, methyl methacrylate, ethyl methacrylate and butyl methacrylate. It is also useful when these components further contain a component of styrene, vinylidene chloride, acrylic acid, methacrylic acid, itaconic acid, itaconic acid esters or butadiene.

These latexes may readily be synthesized of monomers available on the market. The polymerization method thereof is generally an emulsification-polymerization method. It is useful to set a polymerization degree at a degree of the order of 1000 to 1 million by controlling the conditions of such a polymerization reaction. The particle-sizes of such latexes are within the range of 0.01 to 10 μm, and the latexes having a small particle-size of the order of 0.01 to 1 μm should more preferably be used. These latexes may be applied not only to the conductive layers of the invention but also to backing layers or emulsion layers each of which may be the same or the different.

Conductive polymers and latexes each applicable to a conductive layer may be mixed together by dissolving them in an organic solvent or an aqueous solvent. In the methods of mixing and dispersing water-soluble conductive polymers and hydrophobic latexes, they may be prepared by freely controlling the pH and concentration thereof. Such a pH is preferably 3 to 12. The mixing ratio of the conductive polymers with the latexes is preferably 1 to 99.

Typical compounds of such latexes will be exemplified below.

Typical examples of latexes (L-1)

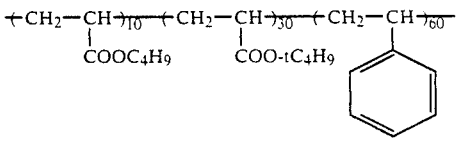

$\overline{M}$ = 100,000

(L-2)

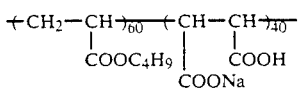

$\overline{M}$ = 200,000

(L-3)

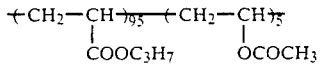

$\overline{M}$ = 300,000

(L-4)

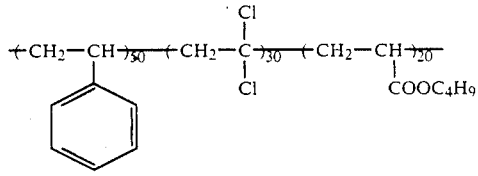

$\overline{M}$ = 200,000

(L-5)

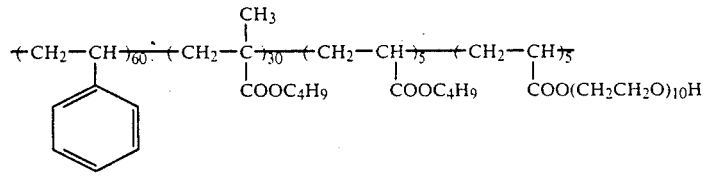

$\overline{M}$ = 300,000

(L-6)

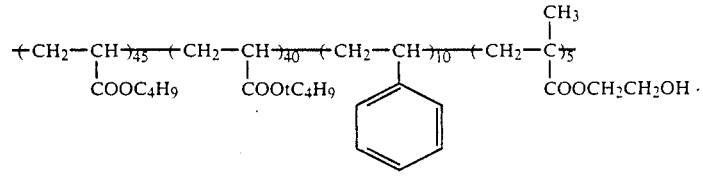

$\overline{M}$ = 500,000

(L-7)

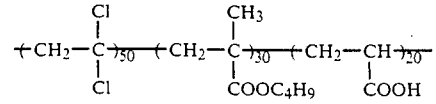

-continued $\overline{M}$ = 200,000

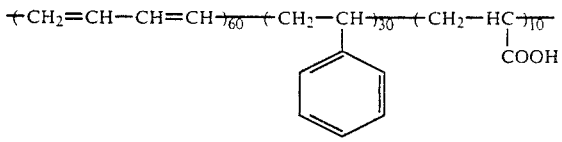

(L-8)

$\overline{M}$ = 600,000

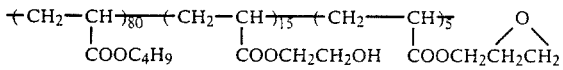

(L-9)

$\overline{M}$ = 150,000

A conductive layer coating solution in which a conductive polymer and a latex are mixed is coated on a support either directly or after undercoating the support. Any cross-linking degrees may be so determined as to harden the conductive layer. For obtaining the aimed characteristics, however, it is preferable to determine the better conditions, because the mixing ratio of a conductive polymer with a latex, the coating and drying conditions of a conductive layer, the selection and amount of a cross-linking agent used, and so on may influence the characteristics. When determining these conditions properly, it is possible to obtain a preferable cross-linking degree of the conductive layer after coated and dried.

The layer thicknesses of conductive layers have a close relation to conductivity. From the viewpoint that the characteristics of a conductive layer may be improved by increasing the unit area, it would be better to make the conductive layer thicker. However, on the other hand, the flexibility of a film may thereby diminished. It may, therefore, be able to obtain a better result when the layer thickness is set within the range of 0.1 to 100 μm and, more preferably, 0.1 to 10 μm.

It is preferable that the surface of the conductive layer of the invention should be activated in a corona-discharge, glow-discharge, UV-rays or flame treatment. The more preferable treatment is the corona-discharge treatment. Such corona-discharge treatment should preferably be carried out in a ratio of 1 mw to 1 kw/m$^2$.min. More preferable energy intensity is within the range of 0.1 w to 1 w/m$^2$min.

The conductive layers of the invention should be cross-linked in the presence of either one of the following cross-linking agents:

As the cross-linking agent, an epoxy cross-linking agent and a peptide reagents are preferably used. Among these, epoxy compounds are most preferable.

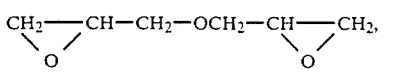

(A-1)

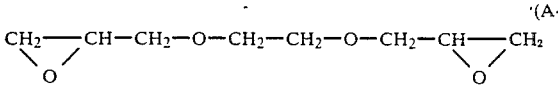

(A-2)

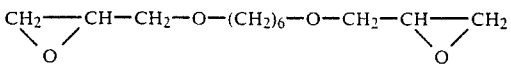

(A-3)

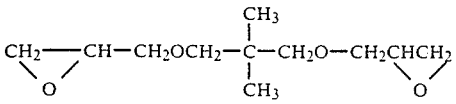

(A-4)

-continued

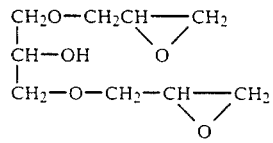

(A-5)

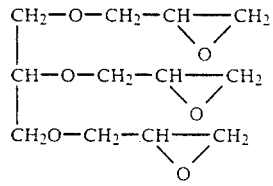

(A-6)

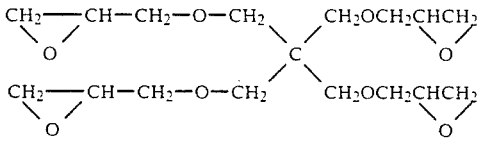

(A-7)

Peptide reagents including, for example,

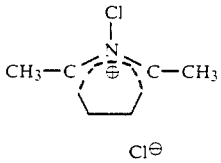

(A-8)

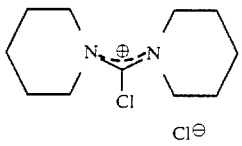

(A-9)

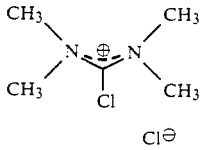

(A-10)

The conductive layers of the invention are to be so bridged as to have a swelling degree within the range of preferably 0.2 to 300% and more preferably 20 to 200%. In the invention, the swelling degrees depend on the quantities and kinds of bridging agents and the combinations of the quantities and kinds of both latexes and conductive polymers too. It is, therefore, necessary to control the quantities and kinds of such raw materials. The swelling degrees further depend on the reaction conditions such as temperatures and pH values. Therefore, it is also necessary to control the factors of the conditions properly.

The reason why the swelling degrees should be controlled is not still clear, however, the inventors consider the reason as follows:

When a swelling degree of a conductive layer exceeds the range specified in this invention, water-soluble ions (i.e., an alkali metal ions) capable of providing conductivity are eluted in a developer, a fixer and a washing beth during the light-sensitive material of the invention is processed and, on the contrary, water-soluble ions capable of providing unconductivity are liable to be introduced from outside into a film. Therefore, the conductivity of the film is lowered. To the contrary, when the swelling degree is too low, the conductive substances in the film are inhibited from migrating therein, so that the conductivity is lowered. Therefore, the film is liable to be statically charged to attract fine dusts from the air so as to adhere to the film surface. It is considered that the above-described phenomena will cause pinholes.

For achieving the objects of the invention, it can, therefore, be understood that an optimum swelling degree should necessarily be set. According to the experiments tried by the inventors, such a swelling as mentioned above is to be not higher than 300% and preferably not higher than 200%.

A swelling degree may be measured in the manner that a conductive layer (or a film) is dipped in pure water having a temperature of 25° C. for 3 minutes and, after dipping, the layer thickness is measured by reading it through an optical microscope. The swelling degrees can be calculated out from the ratio of the above-mentioned layer thickness hw to dried thickness hd at a temperature of 25° C. and a relative humidity of 50%RH:

$$\text{Swelling degree} = \frac{hw - hd}{hd} \times 100$$

The conductive layers of the invention should preferably be coated within the range of viscosity of 1 to 50 cp. To adjust it to be within the range, it is permit ted to adjust the viscosity by controlling an amount of the conductive polymers or by diluting the coating solution. It is further preferable to dry up the conductive layers within the range of 100° to 200° C. for not longer than 2 minutes.

A metal oxide may be added into the conductive lay of the invention according to necessity.

As for the metal oxides applicable to a conductive layer, either one of indium oxide, tin oxide and the metal oxides each doped with an antimony or phosphorus atom, or the combination thereof may be used, if required.

As for the indium oxides, indous oxide ($In_2O$) and indic oxide ($In_2O_3$) are known. However, in the invention, indic oxide should preferably be used.

As for tin oxides, stannous oxide (SnO) and stannic oxide ($SnO_2$) are known. However, in the invention, stannic oxide should preferably be used.

As for the metal oxides each doped with an antimony or phosphorus atom, tin oxide and indium oxide may be given as the examples thereof The above-mentioned metal oxides may be doped with an antimony or phosphorus atom in such a manner that the halide, alkoxide or nitrate of tin or antimony and the halide, alkoxide or nitrate of antimony or phosphorus are mixed together and the mixture is so baked as to be oxidized. These metal compounds may readily be available. When doping antimony or phosphorus, the preferable contents thereof are 0.5 to 10% by weight to tin or indium contents. It is preferred to add these inorganic compounds into the light-sensitive material in the a manner that they are dispersed in a hydrophilic colloid such as gelatin, or they are dispersed in a macromolecular compound such as a polymer of acrylic acid or maleic acid compound. The preferred carrying proportion thereof per a binder is 1 to 100% by weight.

It is preferred to provide adhesive layers each comprising gelatin or a gelatin derivative onto the conductive layer of the invention. These adhesive layers may be double-coated at the same time when coating the conductive layer, or may be coated after the conductive layer is dried.

The adhesive layers should preferably be subjected to a heat-treatment at a temperature within the range of 70° C. to 200° C., and may also be applied with a variety of hardeners. However, these hardeners may be freely selected from the group consisting of those of the acrylamide type, aldehyde type, aziridine type, peptide type, epoxy type and vinyl sulfone type, from the viewpoints of the cross-linkage to the lower conductive layer and the cross-linkage to the upper backing layer.

In the silver halide photographic light-sensitive material relating to the invention, silver halide applicable thereto include, for example, silver chloride, silver chlorobromide, silver chloroiodobromide, and so on, each having any compositions. However, it is particularly preferable that such silver halide contains at least 50 mol % of silver chloride or silver bromide. Such silver halides should preferably be used when their average grain-sizes are within the range of 0.025 to 1.5 μm and, more preferably, 0.05 to 0.30 μm.

In the silver halide grains relating to the invention, the monodispersion degrees thereof are defined by the following Formula (1), and the value thereof should preferably be adjusted within the range of 5 to 60 and, more preferably, 8 to 30. For convenience' sake, the grain-sizes of silver halides relating to the invention are represented by the edge-length of a cubic crystal grain, and the monodispersion degrees thereof are represented by a numeral value 100 times as many as a value obtained by dividing the standard deviation value of a gain-size by an average grain-size.

$$\sqrt{\frac{\Sigma(\bar{r} - ri)^2 ni}{\Sigma ni}} + \bar{r} \times 100 \quad (1)$$

The silver halides applicable to the invention include, preferably, those having at least a double or more multi layered structure. For example, they may be silver chlorobromide grains containing silver chloride in the core portions and silver bromide in the shell portions thereof or, on the contrary, silver chlorobromide grains containing silver bromide in the core portions and silver chloride in the shell portions thereof. In these instances, an iodide may be contained in an amount of not more than 5 %mols in any layers. If occasion demands, the shell portion may contain rhodium atom in an amount within the range of $10^{-9}$ to $10^{-4}$ per mol of silver halides used.

Besides the above, two or more kinds of grains may be used together in the form of mixture. For example, it is allowed to use a mixture of silver halide emulsion grains comprising, as the principal emulsion grains, cubic, octahedral or tabular-shaped silver chloroiodobromide grains each containing silver chloride in an amount of not more than 10 mol % and an iodide in an amount of not more than 5 mol % and, as the secondary emulsion grains, cubic, octahedral or tabular-shaped silver chloroiodobromide grains each containing silver chloride in an amount of not less than 50 mol % and an iodide in an amount of not more than 5 mol %. When using the mixture of grains as mentioned above, it is arbitrary to chemically sensitize the principal and secondary grains. The secondary grains may be desensitized by making moderate a chemical sensitization (such as a sulfur sensitization and a gold sensitization) more moderate than in the case of the principal grains, or by adjusting the grain-sizes or an amount of noble metal such as rhodium which is to be doped in the grains. Besides, the inside of the secondary grains may be fogged by making use of gold or by changing the compositions of the cores and shells in a core/shell method. The smaller the principal and secondary grains are, the better. For example, it is permitted to use any grain-sizes within the range of 0.025 μm to 1.0 μm.

When preparing a silver halide emulsion applicable to the invention, the sensitivity or the contrast thereof may be controlled by adding a rhodium salt. It is generally prefer able to add the rhodium salt when grains are formed. It is, however, permitted to add it either when a chemical ripening is carried out or when an emulsion coating solution is prepared.

Rhodium salts which may be added to silver halide emusions applicable to the invention may be the double salts as well as the simple salts thereof. They include, for example, rhodium choride, rhodium trichloride and rhodiumammonium chloride.

Though such rhodium salts may be added in any amount so as to meet a desired sensitivity or contrast, it is particularly useful to add them in an amount within the range of $10^{-9}$ mols to $10^{-4}$ mols per mol of silver used.

Besides the rhodium salts, it is permitted to use other inorganic compounds such as iridium salts, platinum salts, thallium salts, cobalt salts and gold salts, independently or in combination. For the purpose of improving high intensity exposure characteristics, the iridium salts may often be used preferably within the range of $10^{-9}$ mols to $10^{-4}$ mols per mol of silver.

The silver halide grains applicable to the invention may further be sensitized with various kinds of chemical sensitizers. Such chemical sensitizers include, for example, active gelatin; sulfur sensitizers, such as sodium thiosulfate, allylthiocarbamide, thiourea and allylisothiocyanate; selenium sensitizers such as N,N-dimethylseleno-urea and selenourea; reduction sensitizers such as tri-ethylene tetramine and stannous chloride; and various noble-metal sensitizers typically including potassium chloro-aurite, potassium aurithiocyanate, potassium chloroaurate, 2-aurosulfobenzothiazolemethylchloride, ammonium chloropalladate, potassium chloroplatinate and sodium chloropalladite. These chemical sensitizers may be used independently or in combination. When using such a gold sensitizer, ammonium thiocyanate may also be used as an assistant.

The silver halide emulsions applicable to the invention may be stabilized with the compounds described in the specifications or official gazettes of, for example, U.S. Pat. Nos. 2,444,607, 2,716,062 and 3,512,983; West German DAS Patent Nos. 1,189,380, 2,058,626 and 2,118,411; Japanese Patent Examined Publication No. 43-4133(1968); U.S. Pat. No. 3,342,596; Japanese Patent Examined Publication No. 47-4417(1972); West German DAS Patent Nos. 2,149,789; and Japanese Patent Examined Publication Nos. 39-2825(1964) and 49-13566(1974). These compound preferably include, for example, 5,6-trimethylene-7-hydroxy-S-triazolo(1,5-a)pyrimidine, 5,6-tetramethylene-7-hydroxy-S-triazolo(1,5-a)pyrimidine, 5-methyl-7-hydroxy-S-triazolo(1,5-a)pyrimidine, 5-methyl-7-hydroxy-S-triazolo(1,5-a)pyrimidine, 7-hydroxy-S-triazolo(1,5-a)pyrimidine, 5-methyl-6-bromo-7-hydroxy-S-triazolo(1,5-a)pyrimidine, gallic acid esters such as isoamyl gallate, dodecyl gallate, propyl gallate and sodium gallate, mercaptans such as 1-phenyl-5-mercaptotetrazole and 2-mercaptobenzthiazole, benzotriazoles such as 5-brombenztriazole and 5-methylbenztriazole, and benzimidazoles such as 6-nitrobenzimidazole.

It is preferred to add an amino compound into the silver halide photographic light-sensitive materials and/or the developers each relating to the invention.

Such amino compounds preferably applicable to the invention include all the primary through quaternary amines. Alkanol amines may be given as a preferable example of the amino compounds. The typical examples of such preferable compounds will be given below. It is, however, to be understood that such compounds shall not be limited thereto.

Diethylaminoethanol,
Diethylaminobuthanol,
Diethylaminopropane-1,2-diol,
Dimethylaminopropane-1,2-diol,
Diethanolamine,
Diethylamino-1-propanol,
Triethanolamine,
Dipropylaminopropane-1,2-diol,
Dioctylamino-1-ethanol,
Dioctylaminopropane-1,2-diol,
Dodecylaminopropane-1,2-diol,
Dodecylamino-1-propanol,
Dodecylamino-1-ethanol,
Aminopropane-1,2-diol,
Diethylamino-2-propanol,
Dipropanolamine,
Glycine,
Triethylamine, and
Triethylenediamine Such amino compound may be contained in at least one layer of the layers coated on the light-sensitive layer coated side of a silver halide photographic light-sensitive material, such as the hydrophilic colloidal layers including a silver halide emulsion layers, protective layers and subbing layers, and/or a developer. The preferable embodiment is to contain the amino compound in the developer. Though such amino compounds may be added in a various amount to meet the subjects to be added and the kinds of such amino compounds, it is necessary to add them to increase contrasts.

For increasing developability, it is permitted to add such a developing agent as phenidone or hydroquinone and such an inhibitor as benzotriazole in the emulsion side of a light-sensitive material. Or, it is also permitted to add such a developing agent and inhibitor as mentioned above to a backing layer for improving the processing capacity of a processing solution.

A hydrophilic colloid which is particularly advantageous to the invention is gelatin. Such gelatins also include gelatin derivatives such as phenylcarbamyl gelatin described in, for example, U.S. Pat. Nos. 2,614,928 and 2,525,753; acylated gelatins; phthalated gelatins; or those graft-polymerizing gelatin with a polymerizable monomer having an ethylene group, such as styrene acrylate, acrylic acid esters, methacrylic acid and methacrylic acid esters each described in, for example, U.S. Pat. No. 2,548,520 and 2,831,767. These hyrophilic colloids may also be applied to a layer not containing silver halides, such as an antihalation layer, a protective layer and an interlayer.

If required, silver halide photographic light-sensitive material applicable to the invention may contain a hydrazine compound, atetrazolium compound or a polyalkyleneoxide compound.

The hydrazine compounds which may adatageously be used in the invention include, preferaly, those represented by the following Formula [H]:

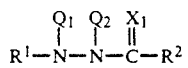

Formula [H]

wherein $R^1$ is a monovalent organic residual group; $R^2$ is a hydrogen atom or a monovalent organic group; $Q_1$ and $Q_2$ are each a hydrogen atom, an alkylsulfonyl group, including those having a substituent, or an arylsulfonyl group, including those having a substituent; and $X_1$ is an oxygen atom or a sulphur atom. Among the compounds, a compound of which $X_1$ is an oxygen atom and $R^2$ is an hydrogen atom may further preferably be used.

The monovalent groups represented each by $R^1$ and $R^2$ include, for example, an aromatic group, a heterocyclic group and an aliphatic group.

The aromatic groups include, for example, a phenyl group, a naphthyl group and those having a substituent such as an alkyl group, an alkoxy group, an acylhydrozino group, a dialkylamino group, an alkoxycarbonyl group, a cyano group, a carboxy group, a nitro group, an alkylthio group, a hydroxy group, a sulfonyl group, a carbamoyl group, a halogen atom, an acylamino group, a sulfonamido group and a thiourea group. The groups each having such a substituent include, for example, a 4-methylphenyl group, a 4-ethylphenyl group, a 4-oxyethylphenyl group, a 4-dodecylphenyl group, a 4-carboxyphenyl group, a 4-diethylaminophenyl group, a 4-octylaminophenyl group, a 4-benzylaminophenyl group, a 4-acetoamido-2-methylphenyl group, a 4-(3-ethylthioureido)phenyl group, a 4-[2-(2,4-di-tert-butylphenoxy)butylamido]phenyl group, and a 4-[2-(2,4-di-tert-butylphenoxy)-butylamido]phenyl group.

The heterocyclic groups are of the 5 or 6 membered single or condensed ring having at least one atom selected from the group consisting of oxygen atom, nitrogen atom, sulfur atom and selenium atom, and may also be those having a substituent. These groups include, for example, those of a pyrroline ring, pyridine ring, quinoline ring, indole ring, oxazole ring, benzoxazole ring, naphthooxazole ring, imidazole ring, benzoimidazole ring, thiazoline ring, thiazole ring, benzothiazole ring, naphthothiazole ring, selenazole ring, benzoselenazole ring and naphthoselenazole ring.

The above-given heterocyclic rings may be substituted with an alkyl group having 1 to 4 carbon atoms, such as a methyl group and an ethyl group; an alkoxy group having 1 to 4 carbon atoms, such as a methoxy group and an ethoxy group; an aryl group having 6 to 18 carbon atoms, such as a phenyl group; a halogen atom such as chlorine atom and bromine atom; an alkoxycarbonyl group; a cyano group; or an amino group.

The aliphatic groups include, for example, straight-chained or branched alkyl group, a cycloalkyl group, those having a substituent, an alkenyl group, and an alkinyl group.

The straight-chained or branched alkyl groups are those having, for example, 1 to 18 carbon atoms and, preferably, 1 to 8 carbon atoms. They include, for example, a methyl group, an ethyl group, an isobutyl group and a 1-octyl group.

The cycloalkyl groups are, for example, those having 3 to 10 carbon atoms. They include, for example, a cyclopropyl group, a cyclohexyl group and an adamantyl group. The substituents to the alkyl or cycloalkyl groups include, for example, an alkoxy group such as a methoxy group, an ethoxy group, a propoxy group and a butoxy group, an alkoxycarbonyl group, a carbamoyl group, a hydroxy group, an alkylthio group, an amido group, a siloxy group, a cyano group, a sulfonyl group, a halogen atom such as chlorine atom, bromine atom, fluorine atom and iodine atom, and an aryl group such as a phenyl group, a halogen-substituted phenyl group and alkyl-substituted phenyl group. The substituted groups include, for example, a 3-methoxy propyl group, an ethoxycarbonylmethyl group, a 4-chlorocyclohexyl group, a benzyl group, a p-methylbenzyl group and a p-chlorobenzyl group. The alkenyl groups include, for example, an allyl group, and the alkynl groups include, for example, a propargyl group.

The preferable examples of the hydrazine compounds of the invention will be given below. It is, however, to be understood that the invention shall not be limited thereto.

(H-1) 1-formyl-2-{4-[2-(2,4-di-tert-butylphenoxy)-butylamido]phenyl}hydrozine,
(H-2) 1-formyl-2-(4-diethylaminophenyl)hydrazine,
(H-3) 1-formyl-2-(p-tolyl)hydrazine,
(H-4) 1-formyl-2-(4-ethylphenyl)hydrazine,
(H-5) 1-formyl-2-(4-acetoamido-2-methylphenyl)hydrazine,
(H-6) 1-formyl-2-(4-oxyethylphenyl)hydrazine,
(H-7) 1-formyl-2-(4-N,N-dihydroxyethylaminophenyl)-hydrazine,
(H-8) 1-formyl-2-[4-(3-ethylthioureido)phenyl]hydrazine,
(H-9) 1-thioformyl-2-{4-[2-(2,4-di-tert-butylphenoxy)-butylamido]phenyl}hydrazine,
(H-10) 1-formyl-2-(4-benzylaminophenyl)hydrazine,
(H-11) 1-formyl-2-(4-octylaminophenyl)hydrazine,
(H-12) 1-formyl-2-(4-dodecylphenyl)hydrazine,
(H-13) 1-acetyl-2-{4-2-2,4-di-tert-butylphenoxy)-butylamido]phenyl}hydrazine,
(H-14) 4-carboxyphenylhydrazine,
(H-15) 1-acetyl-1-(4-methylphenylsulfonyl)-2-phenyl-hydrazine,
(H-16) 1-ethoxycarbonyl-1-(4-methylphenylsulfonyl)-2-phenylhydrazine,
(H-17) 1-formyl-2-(4-hydroxyphenyl)-2-(4-methyl-phenylsulfonyl)-hydrazine,
(H-18) 1-(4-acetoxyphenyl)-2-formyl-1-(4-methyl-phenylsulfonyl)-hydrazine,
(H-19) 1-formyl-2-(4-hexanoxyphenyl)-2-(4-methyl-phenylsulfonyl)-hydrazine, (H-20) 1-formyl-2-[4-(tetrahydro-2H-pyrane-2-yloxy)-phenyl]-2-(4-methylphenylsulfonyl)-hydrazine, (H-21) 1-formyl-2-[4-(3-hexylureidophenyl)]-2-(4-methylphenylsulfonyl)-hydrazine, (H-22) 1-formyl-2-(4-methylphenylsulfonyl)-2-[4-(phenoxythiocarbonylamino)-phenyl]-hydrazine, (H-23) 1-(4-ethoxythiocarbonylaminophenyl)-2-formyl-1-(4-methylphenylsulfonyl)-hydrazine, (H-24) 1-formyl-2-(4-methylphenylsulfonyl)-2-[4-(3-methyl-3-phenyl-2-thioureido)-phenyl]-hydrazine, (H-25) 1-{{4-{3-[4-(2,4-bis-t-amylphenoxy)-butyl]-ureido}phenyl}}-2-formyl-1-(4-methylphenylsulfonyl)-hydrazine, (H-26)

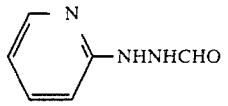

(H-27)

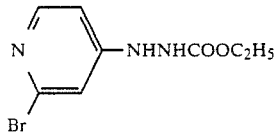

(H-28)

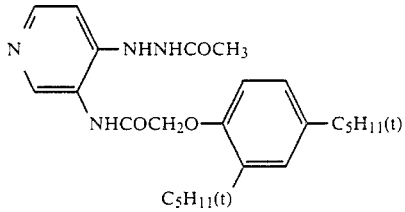

(H-29)

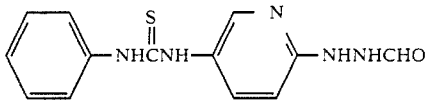

(H-30)

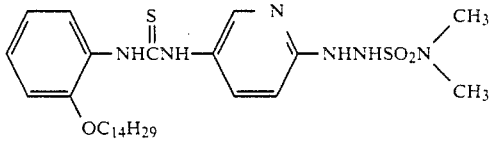

(H-31)

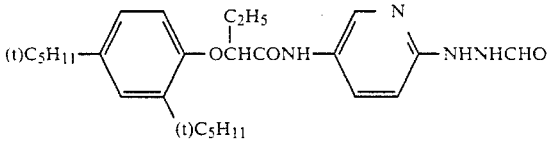

(H-32)

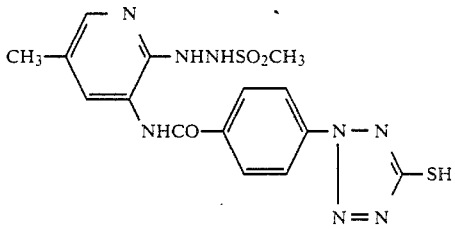

(H-33)

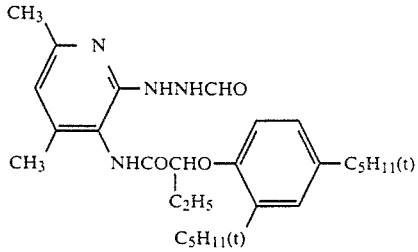

-continued
(H-34)
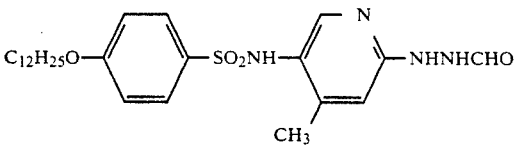
(H-35)
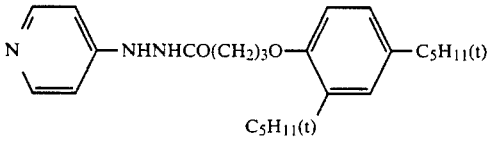
(H-36)
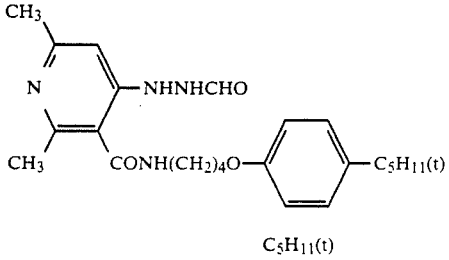
(H-37)
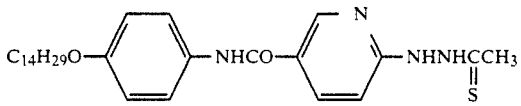
(H-38)
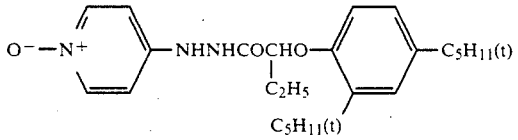
(H-39)
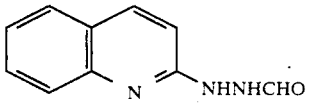
(H-40)
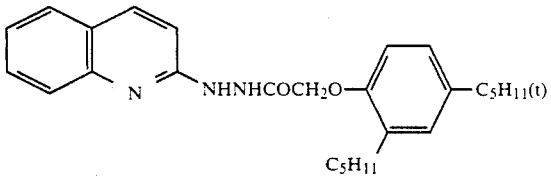
(H-41)
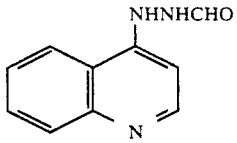
(H-42)
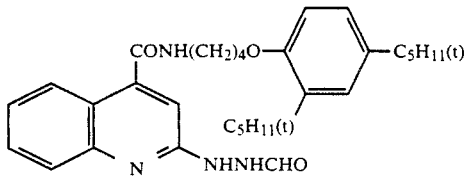
(H-43)
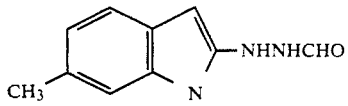

-continued
(H-44)
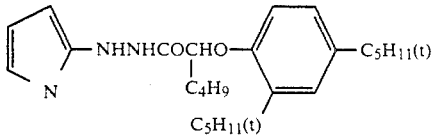
(H-45)
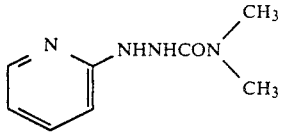
(H-46)
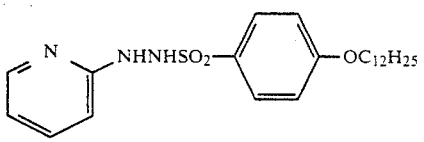
(H-47)
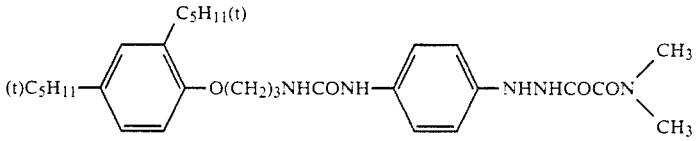
(H-48)
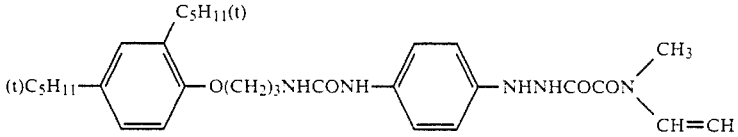
(H-49)
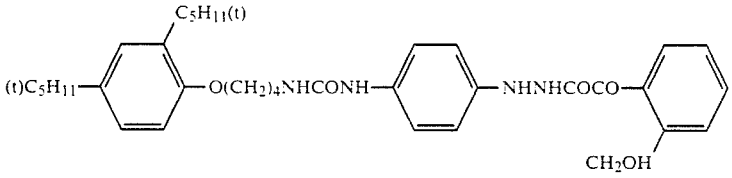
(H-50)
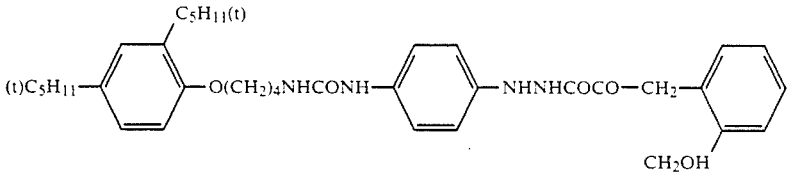
(H-51)
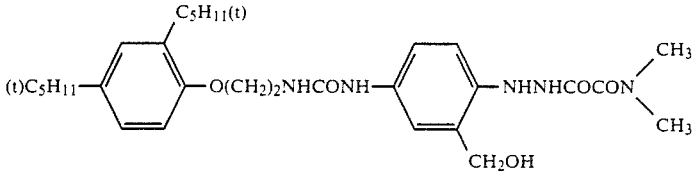
(H-52)
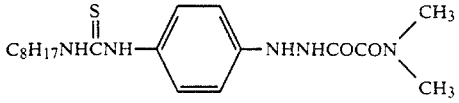
(H-53)
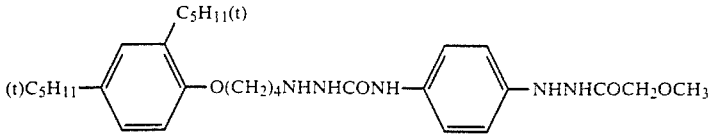

-continued (H-54)

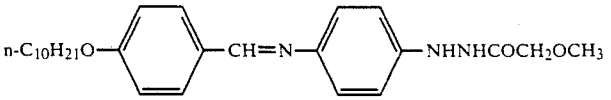

(H-55)

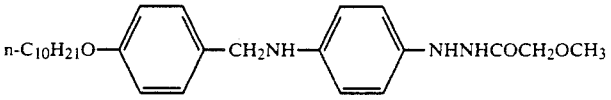

(H-56)

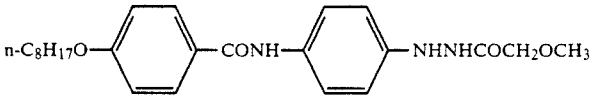

(H-57)

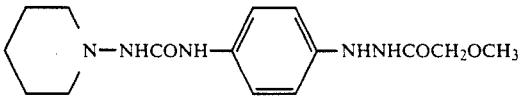

(H-58)

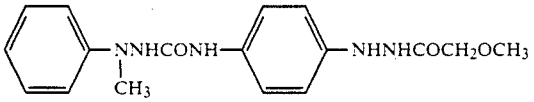

(H-59)

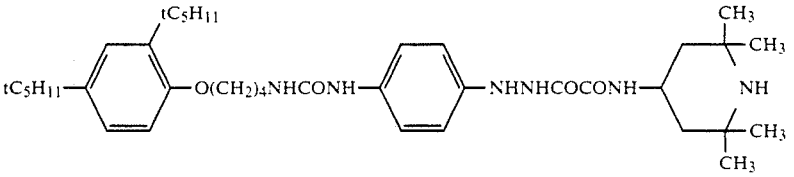

The positions for adding the hydrazine compounds represented by Formula [H] are a silver halide emulsion layer and/or a non-light-sensitive layer coated on the silver halide emulsion layer side of a support and, preferably, the silver halide emulsion layer and/or the lower layer thereof. The hydrazine compounds may be added in an amount of $10^{-5}$ to $10^{-1}$ mols per mol of silver and, preferably $10^{-4}$ to $10^{-2}$ mols per mol of silver.

Next, the terazolium compounds which may be used in the invention if required will be detailed.

The terazolium compounds may be represented by the following Formula [Tb], [Tc] or [Td]:

Formula [Tb]

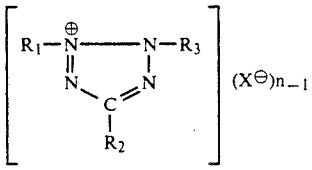

Formula [Tc]

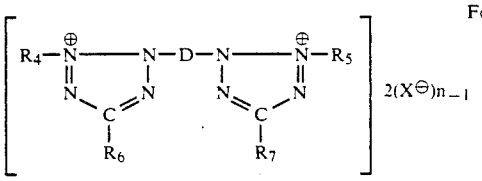

-continued

Formula [Td]

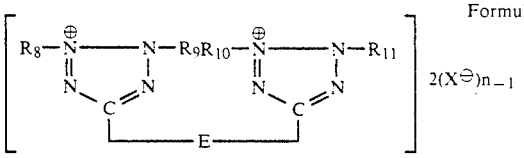

wherein $R_1$, $R_3$, $R_3$, $R_4$, $R_5$, $R_8$, $R_9$, $R_{10}$ and $R_{11}$ are each a group selected from the group consisting of an alkyl group such as a methyl group, an ethyl group, a propyl group and a dodecyl group, an alkenyl group such as a vinyl group, an allyl group and a propenyl group, an aryl group such as a phenyl group, a tolyl group, a hydroxyphenyl group, a carboxyphenyl group, an aminophenyl group, a mercaptophenyl group, an α-naphthyl group, a β-naphthyl group, a hydroxynaphthyl group, a carboxynaphthyl group and an aminonaphthyl group, and a hetercyclic group such as a thiazolyl group, a benzothiazolyl group, an oxazolyl group, a pyrimidinyl group and a pyridyl group, provided, they may be such a group as is capable of forming a metal chelate or a complex.

$R_2$, $R_6$ and $R_7$ are each a group, which may have a substituent, selected from the group consisting of an allyl group, a phenyl group, a naphthyl group, a hetercyclic group, an alkyl group such as a methyl group, an ethyl group, a propyl group, a butyl group, a mercaptomethyl group and a mercaptoethyl group, a hydroxyl group, a carboxyl group and the salts thereof, an alkoxycarbonyl group such as a methoxycarbonyl group and an ethoxycarbonyl group, an amino group such as an amino group, an ethylamino group and an anilino group, a mercapto group, a nitro group, or a hydrogen atom. D is a divalent aromatic group. E is a group selected from the group consisting of an alkylene group, an allylene group and an aralkylene group. $X^{\oplus}$ is an anion. n is an integer of 1 or 2, provided, n is 1 when the compound forms an intramolecular salt.

Next, the examples of the tetrazolium compounds having the foregoing Formula [Tb], [Tc] or [Td] will be given below. It is, however, to be understood that the invention shall not be limited thereto.

(T-1)2-(benzothiazole-2-yl)-3-phenyl-5-dodecyl-2H-tetrazolium,
(T-2) 2,3-diphenyl-5-(4-t-octyloxyphenyl)-2H-tetrazolium,
(T-3) 2,3,5-triphenyl-2H-tetrazolium,
(T-4) 2,3,5-tri(p-carboxyethylphenyl)-2H-tetrazolium,
(T-5) 2-(benzothiazole-2-yl)-3-phenyl-5-(o-chlorophenyl)-2H-tetrazolium,
(T-6) 2,3-diphenyl-2H-tetrazolium,
(T-7) 2,3-diphenyl-5-methyl-2H-tetrazolium,
(T-8) 3-(p-hydroxyphenyl)-5-methyl-2-phenyl-2H-tetrazolium,
(T-9) 2,3-diphenyl-5-ethyl-2H-tetrazolium,
(T-10) 2,3-diphenyl-5-n-hexyl-2H-tetrazolium,
(T-11) 5-cyano-2,3-diphenyl-2H-tetrazolium,
(T-12) 2-(benzothiazole-2-yl)-5-phenyl-3-(4-tolyl)-2H-tetrazolium,
(T-13) 2-(benzothiazole-2-yl)-5-(4-chlorophenyl)-3-(4-nitrophenyl)-2H-tetrazolium,
(T-14) 5-ethoxycarbonyl-2,3-di(3-nitrophenyl)-2H-tetrazolium,
(T-15) 5-acetyl-2,3-di(p-ethoxyphenyl)-2H-tetrazolium,
(T-16) 2,5-diphenyl-3-(p-tolyl)-2H-tetrazolium,
(T-17) 2,5-diphenyl-3-(p-iodophenyl)-2H-tetrazolium,
(T-18) 2,3-diphenyl-5-(p-diphenyl)-2H-tetrazolium,
(T-19) 5-(p-bromophenyl)-2-phenyl-3-(2,4,6-trichlorophenyl)-2H-tetrazolium,
(T-20) 3-(p-hydroxyphenyl)-5-(p-nitrophenyl)-2-phenyl-2H-tetrazolium,
(T-21) 5-(3,4-dimethoxyphenyl)-3-(2-ethoxyphenyl)-2-(4-methoxyphenyl)-2H-tetrazolium,
(T-22) 5-(4-cyanophenyl)-2,3-diphenyl-2H-tetrazolium,
(T-23) 3-(p-acetoamidophenyl)-2,5-diphenyl-2H-tetrazolium,
(T-24) 5-acetyl-2,3-diphenyl-2H-tetrazolium,
(T-25) 5-(furan-2-yl)-2,3-diphenyl-2H-tetrazolium,
(T-26) 5-(thiophene-2-yl)-2,3-diphenyl-2H-tetrazolium,
(T-27) 2,3-diphenyl-5-(pyrido-4-yl)-2H-tetrazolium,
(T-28) 2,3-diphenyl-5-(quinol--2-yl)-2H-tetrazolium,
(T-29) 2,3-diphenyl-5-(benzoxazole-2-yl)-2H-tetrazolium,
(T-30) 2,3,5-tri(p-ethylphenyl)-2H-tetrazolium,
(T-31) 2,3,5-tri(p-allylphenyl)-2H-tetrazolium,
(T-32) 2,3,5-tri(p-hydroxyethyloxyethoxyphenyl)-2H-tetrazolium,
(T-33) 2,3,5-tri(p-dodecylphenyl)-2H-tetrazolium,
(T-34) 2,3,5-tri(p-benzylphenyl)-2H-tetrazolium.

In the foregoing Formula [Tb] or [Tc], the anion represented by $X^{\oplus}$ include, for example, halogen ions such as $Cl^{\oplus}$.

The tetrazolium compounds applicable to the invention may be used independently or in combination in any proportions of their contents.

One of the preferable embodiments of the invention is, for example, that the tetrazolium compound relating to the invention is added into a silver halide emulsion layer. Another preferable embodiment of the invention is that the tetrazoilum compound relating to the invention is added into either a non-light-sensitive hydrophilic colloidal layer directly adjacent to a silver halide emulsion layer or a non-light-sensitive hydrophilic colloidal layer adjacent, through an interlayer, to a non-light-sensitive hydrophilic colloidal layer.

A further embodiment of the invention is that the tetrazolium compound relating to the invention may be contained in a light-sensitive material in such a manner that the tetrazoilum compound is dissolved in a suitable solvent including, for example, alcohols such as methanol or ethanol, ethers, or esters, and the solution is directly coated, in an over-coating method, onto the portion where is to become the outermost layer on the silver halide emulsion layer side of the light-sensitive material.

It is preferable to use the tetrazolium compound relating to the invention in an amount within the range of $1\times10^{-6}$ mols to 10 mols and, more preferably, $2\times10^{-4}$ mols to $2\times10^{-1}$ mols per mol of silver halide to be contained in a light-sensitive material of the invention.

The polyalkylene oxide compounds which may be used in the invention if required are the compounds containing at least 2 or more and at the very most 200 or less of polyalkylene oxide chains in the molecules thereof. For example, these compounds may be synthesized in a condensation reaction of polyalkylene oxide with a compound containing the active hydrogen atom of an aliphatic alcohol, a phenol, a fatty acid, a aliphatic mercaptan or an organic mine; or by condensing a polyol such as polypropylene glycol and a polyoxytetramethylene polymer with aliphatic mercaptan, organic amine, ethylene oxide or propylene oxide.

The above-mentioned polyalkylene oxide compounds may also be a block copolymer in which the polyalkylene oxide chains of the molecules may be divided into 2 or more portions, but may not be a single chain.

In this instance, it is preferred when the total polymerization degree of the polyalkylene oxides should be within the range of not less than 3 to not more than 100.

The above-described polyalkylene oxide compounds freely applicable to the invention will be exemplified below.

[Exemplified compounds]

$HO(CH_2CH_2O)_nH$ (n = 35) (Ao-1)

$n\text{-}C_4H_9O(CH_2CH_2O)_lH$ (l = 20) (Ao-2)

$n\text{-}C_8H_{17}O(CH_2CH_2O)_lH$ (l = 30) (Ao-3)

$n\text{-}C_{12}H_{25}O(CH_2CH_2O)_lH$ (l = 30) (Ao-4)

(Ao-5)

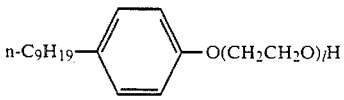

(l = 30)

$n\text{-}C_{12}H_{25}S(CH_2CH_2O)_lH$ (l = 30) (Ao-6)

$C_4H_9S(CH_2CH_2O)_nCOCH_2CH_2COOH$ (n = 50) (Ao-7)

$HO(CH_2CH_2O)_l(CH_2)_m(CH_2CH_2O)nCOCH_2CH_2COOH$ (l + n = 70, m = 5) (Ao-8)

-continued $$HO(CH_2CH_2O)_l(\underset{\underset{CH_3}{|}}{C}HCH_2O)_m(CH_2CH_2O)_nH \quad (Ao\text{-}9)$$
$$(l + n = 15, m = 17)$$

$$HO(CH_2CH_2O)_l(\underset{\underset{CH_3}{|}}{C}HCH_2O)_m(CH_2CH_2O)_nH \quad (Ao\text{-}10)$$
$$(l + n = 30, m = 35)$$

$$HO(CH_2CH_2O)_l(\underset{\underset{C_2H_5}{|}}{C}HCH_2O)_m(CH_2CH_2O)_nH \quad (Ao\text{-}11)$$
$$(l + n = 15, m = 15)$$

$$HO(CH_2CH_2O)_l(\underset{\underset{C_2H_5}{|}}{C}HCH_2O)_m(CH_2CH_2O)_nH \quad (Ao\text{-}12)$$
$$(l + n = 30, m = 15)$$

$$HO(CH_2CH_2O)_l(CH_2CH_2CH_2CH_2O)_m(CH_2CH_2O)_nH \quad (Ao\text{-}13)$$
$$(l + n = 23, m = 21)$$

$$HO(CH_2CH_2O)_l(CH_2CH_2CH_2CH_2O)_m(CH_2CH_2O)_nH \quad (Ao\text{-}14)$$
$$(l + n = 38, m = 15)$$

$$HO(CH_2CH_2O)_l(\underset{\underset{CH_2OCH_3}{|}}{C}HCH_2O)_m(CH_2CH_2O)_nH \quad (Ao\text{-}15)$$
$$(l + n = 15, m = 15)$$

$$HO(CH_2CH_2O)_l(\underset{\underset{CH_2OCH_3}{|}}{C}HCH_2O)_m(CH_2CH_2O)_nH \quad (Ao\text{-}16)$$
$$(l + n = 30, m = 15)$$

$$n\text{-}C_{12}H_{25}O(\underset{\underset{CH_3}{|}}{C}HCH_2O)_l(CH_2CH_2O)_nH \quad (Ao\text{-}17)$$
$$(l = 7, m = 30)$$

$$n\text{-}C_{12}H_{25}S(\underset{\underset{CH_3}{|}}{C}HCH_2O)_l(CH_2CH_2O)_mH \quad (Ao\text{-}18)$$
$$(l = 7, m = 30)$$

$$HOOCCH_2CH_2\overset{\overset{O}{\|}}{C}O(CH_2CH_2O)_l(CH_2CH_2-$$

-continued $$CH_2CH_2O)_m(CH_2CH_2O)_n\overset{\overset{O}{\|}}{C}CH_2CH_2COOH \quad (Ao\text{-}19)$$
$$(l + n = 15, m = 15)$$

$$HOOCCH_2CH_2\overset{\overset{O}{\|}}{C}O(CH_2CH_2O)_l(\underset{\underset{CH_3}{|}}{C}HCH_2O)_m-$$

$$(CH_2CH_2O)_n\overset{\overset{O}{\|}}{C}CH_2CH_2COOH \quad (Ao\text{-}20)$$
$$(l + n = 15, m = 20)$$

$$C_{12}H_{25}N\begin{matrix}(CH_2CH_2O)_lH \\ (CH_2CH_2O)_nH\end{matrix} \quad (Ao\text{-}21)$$
$$(l + n = 30)$$

Transparent supports applicable to the invention include, for example, a polyethylene terephthalate or cellulose triacetate film. Among such transparent supports, those having a light transmittance of not less than 90% in a visible area (of 400 to 700 nm) are preferably used and, if occasion demands, they may be blue-tinted by adding a dye or the like, provided that their transmittance may not be affected by such a tint. When applying a corona-discharge treatment to the above-mentioned transparent support, it is preferable to apply 0.1 to 100 $w/m^2min$ thereto.

Light-sensitive materials of the invention preferably have a backing layer and a backing pretective layer on the surface opposite to the emulsion coated surface of support It is preferable that dyes applicable to the backing layer contain at least one of yellow, magenta, cyan and infrared dyes, provided, two or more dyes may be used in combination.

The following compounds will be given as the prepferably applicable examples of the backing dyes.

(1) Yellow dyes

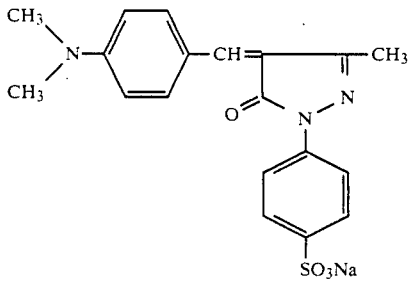

(Y-1)

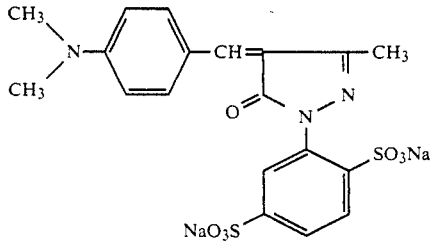

(Y-2)

-continued
(Y-3)
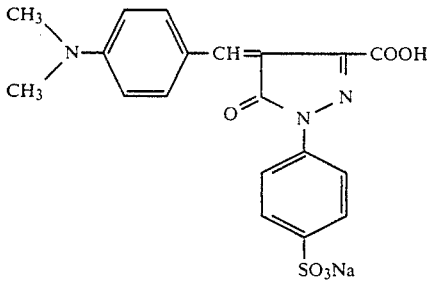
(2) Magenta dyes
(M-1)
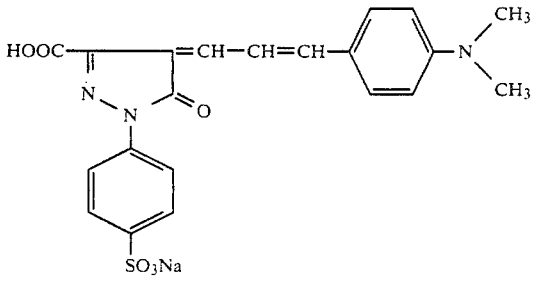
(M-2)
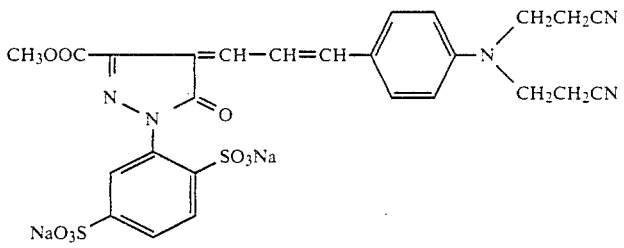
(M-3)
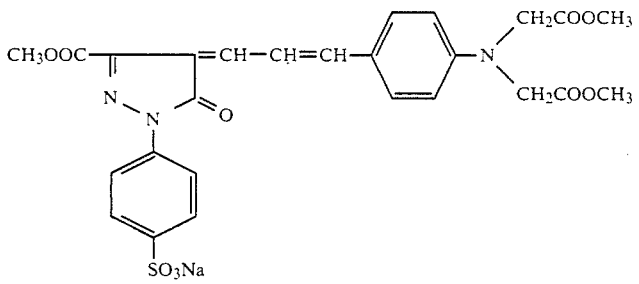
(3) Cyan dyes
(C-1)
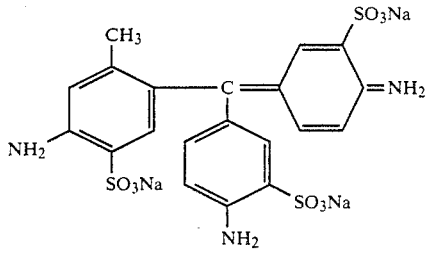
(C-2)
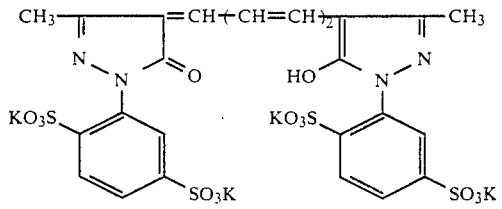

-continued
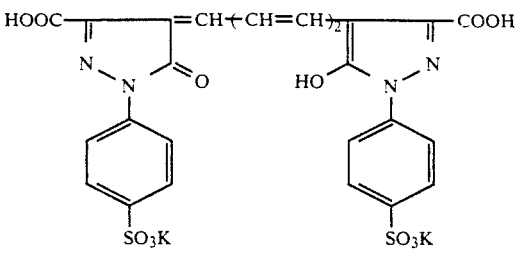
(C-3)
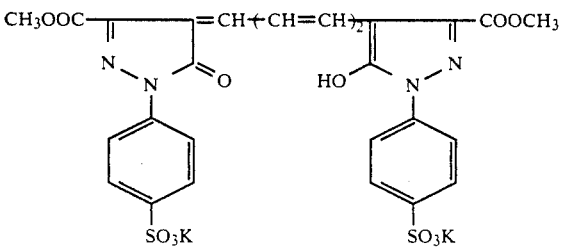
(C-4)
(4) Infrared dyes
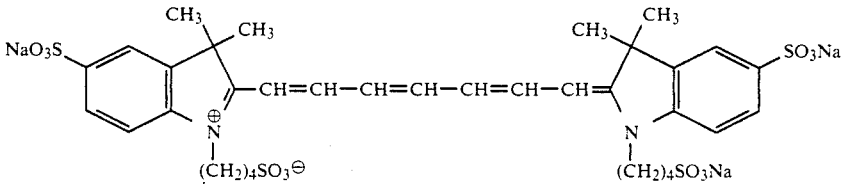
(I-1)
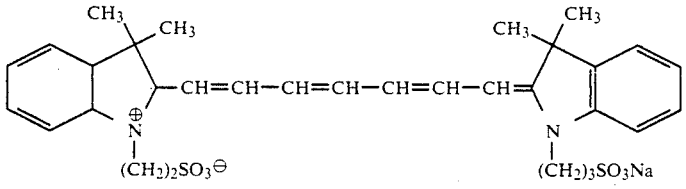
(I-2)
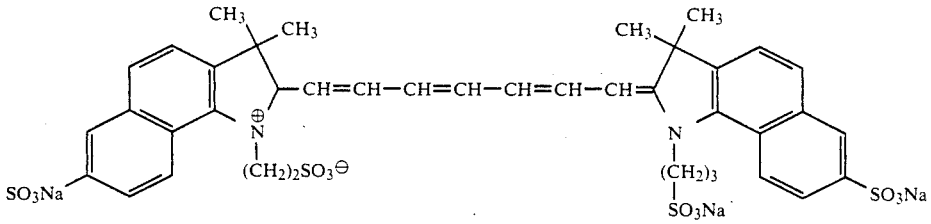
(I-3)
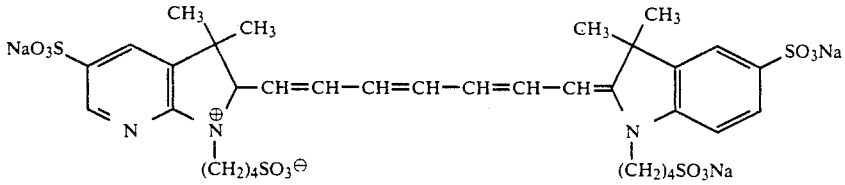
(I-4)
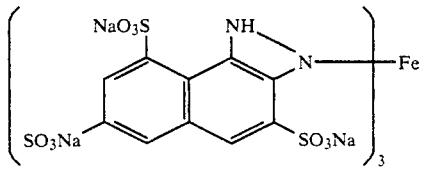
(I-5)
Surfactants containing fluorine are applicable to the backing layer of the invention or the backing protective layer thereof. Such surfactants may be represented by the following Formula [Sa], [Sb], [Sd] or [Se]:

Formula [Sa]

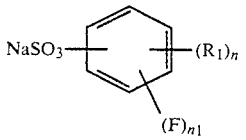

wherein $R_1$ is an alkyl group having 1 to 32 carbon atoms, such as a methyl group, an ethyl group, a propyl group, a hexyl group, a nonyl group, a dodecyl group or a hexadecyl group, provided, these groups are each substituted with at least one fluorine atom; n is an integer of 1 to 3; and $n_1$ is an integer of 0 to 4.

Formula [Sb]

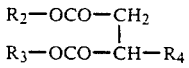

Formula [Sc]

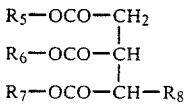

wherein $R_2$, $R_3$, $R_5$, $R_6$ and $R_7$ represent each a straight-chained or branched alkyl group having 1 to 32 carbon atoms, such as a methyl group, an ethyl group, a butyl group, an isobutyl group, a pentyl group, a hexyl group, an octyl group, a nonyl group, a decyl group, a dodecyl group, or an octadecyl group, provided, they may be a cyclic alkyl group and are substituted with at least one fluorine atom. $R_2$, $R_3$, $R_5$, $R_6$ and $R_7$ also represent each an aryl group such as a phenyl group or a naphthyl group, provided, these aryl groups are each substituted with at least one fluorine atom or with a group substituted with at least one fluorine atom.

Further, $R_4$ and $R_8$ represent each an acid group such as a carboxylate group, a sulfonate group or a phosphoric acid group.

Formula [Sd]

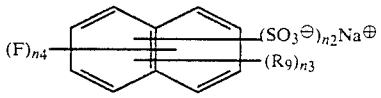

wherein $R_9$ represents a saturated or unsaturated straight-chained or branched aliphatic hydrocarbon group having 1 to 32 carbon atoms, such saturated groups as a methyl group, an ethyl group, a butyl group, an isobutyl group, a hexyl group, a dodecyl group, and an octadecyl group, and unsaturated alkyl groups as for example, an allyl group, a butenyl group and an octenyl group, provided, these staturated or unsaturated aliphatic hydrocarbon groups are each substituted with at least one fluorine atom; $n_2$ and $n_3$ are each an integer of 1 to 3; and $n_4$ is an integer of 0 to 6.

Formula [Se]

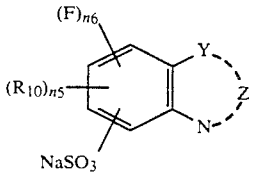

wherein Y is a sulfur atom, a selenium atom, an oxygen atom, a nitrogen atom or an

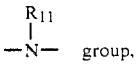

group, in which $R_{11}$ is a hydrogen atom or an alkyl group having 1 to 3 carbon atoms, such as a methyl group or an ethyl group; $R_{10}$ is a group synonymous with the group represented by $R_1$ in the foregoing Formula [Sa] or an aryl group such as a phenyl group or a naphthyl group substituted with at least one fluorine atom, and Z is the group consisting of atoms necessary for forming a 5- or 6-membered heterocyclic ring including, for example, a thiazole ring, a selenazole ring, an oxazole ring, an imidazole ring, a pyrazole ring, a triazole ring, a tetrazole ring, a pyrimidine ring and a triazine ring.

The above-given heterocyclic rings may also have a substituent such as an alkyl group or an aryl group, and these substituents may further be substituted with a fluorine atom.

Next, the typical examples of the surfactants each containing a fluorine atom, which are represented by the foregoing Formulas [Sa] through [Se], will be given below. It is, however, to be understood that the compounds applicable to the invention shall not be limited thereto.

(Exemplified compounds)

(S-1)

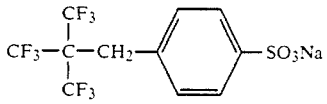

(S-2)

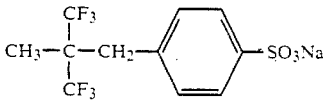

(S-3)

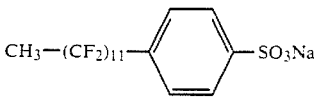

(S-4)

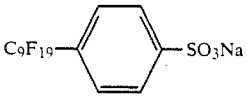

(S-5)

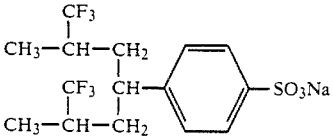

(S-6)

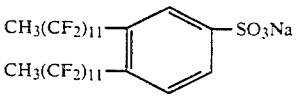

(S-7)

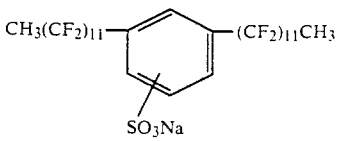

-continued (Exemplified compounds)

(S-8)

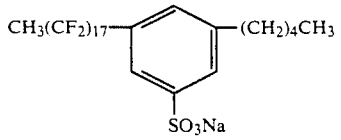

(S-9)

$CF_3C(CF_3)_2CF_2CF(CF_3)-CH_2OOCCH_2$
$CF_3C(CF_3)_2CF_2CF(CF_3)-CH_2OOCCH-SO_3Na$ (S-10)

$CF_3(CF_2)_{11}OOC-CH_2$
$CF_3(CF_2)_{11}OOC-CH-SO_3Na$ (S-11)

$CF_3(CF_2)_{17}OOC-CH_2$
$CF_3(CF_2)_{17}OOC-CHSO_3Na$ (S-12)

$CF_3(CF_2)_5OOCCH_2$
$CF_3(CF_2)_5OOCCH-SO_3Na$ (S-13)

$CF_3(CF_2)_3CF(C_2F_5)CF_2OOC-CH_2$
$CF_3(CF_2)_3CF(C_2F_5)CF_2OOC-CHSO_3Na$ (S-14)

$CF_3(CF_2)_9OOCCH_2$
$CF_3(CF_2)_4OOCCH-SO_3Na$ (S-15)

$C_6F_5OCOCH_2$
$C_6F_5OCOCH-SO_3Na$ (S-16)

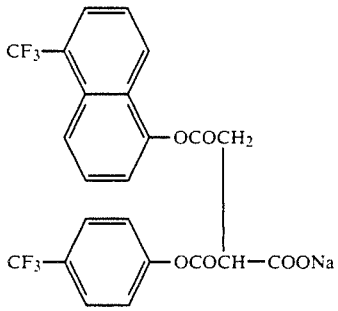

(S-17)

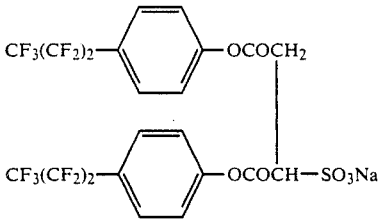

(S-18)

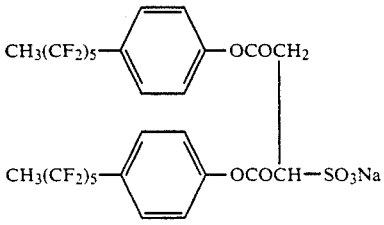

(S-19)

$CF_3(CF_2)_7-OOC-CH_2$
$CF_3(CF_2)_7-OOC-CH$
$CF_3(CF_2)_7-OOC-CH-SO_3Na$

-continued (Exemplified compounds)

(S-20)

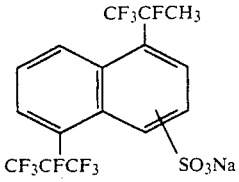

(S-21)

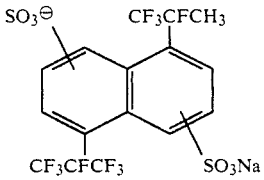

(S-22)

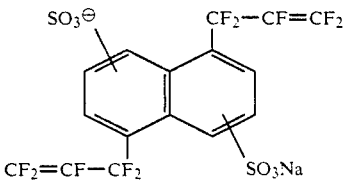

(S-23)

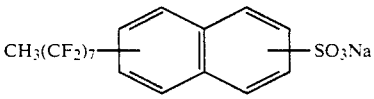

(S-24)

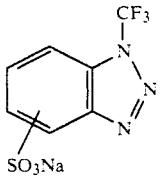

(S-25)

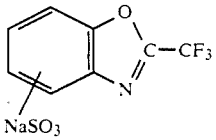

(S-26)

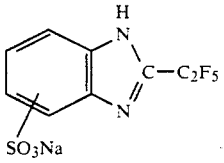

(S-27) $H-(CF_2)_6CH_2-O-CH_2CH_2-SO_3Na$ (S-28) $H(CF_2)_8CH_2-O-CH_2CH_2-SO_3Na$ (S-29) $C_6F_5CH-OCH_2CH_2-SO_3Na$ (S-30)

$NaO_3SCH-COOCH_2(CF_2CF_2)_3H$
$CH_2COOC_5H_{11}(iso)$ (S-31)

$NaO_3S-CH-COOCH_2(CF_2CF_2)_3H$
$CH_2-COOCH_2CHC_4H_9$
$C_2H_5$

-continued (Exemplified compounds)

(S-32) $NaO_3S-CH(CH_2COOCH_2-C_6H_{11})-COOCH_2(CF_2CF_2)_3H$ (S-33) $NaO_3S-CH(CH_2COOC_3H_{7(n)})-COOCH_2(CF_2CF_2)_4H$ (S-34) $NaO_3S-CH(CH_2COOCH_3)-COOCH_7(CF_2CF_2)_7H$ (S-35) $NaO_3S-CH(CH_2COOC_{10}H_{21(n)})COOCH_2CF_2CF_2H$ (S-36) $NaO_3S-CH(CH_2COOCH_2CH_2-C_6H_5)-COO(CF_2CF_2)_2H$ (S-37) $NaO_3S-CH(CH_2COOC_9H_{19(iso)})-COOCH_2(CF_2CF_2)_2H$ (S-38) $NaO_3S-CH(CH_2COOC_6H_{13(n)})COOCH_2(CF_2CF_2)_2H$ (S-39) $NaO_3S-CH(CH_2-COOCH_2(CF_2)_5H)-COOCH_2(CF_2)_6H$ (S-40) $HO(CF_2-CF_2-O)_{30}H$ (S-41) $C_7F_{15}CH_2(OCH_2CH_2)_{13}OH$ (S-42) $C_9H_{19}-C_6H_4-O(CF_2CF_2O)_{10}H$ (S-43) $n\text{-}C_8F_{17}SO_3K$ (S-44) $C_9F_{17}O-C_6H_4-SO_3Na$ It is preferable that the calcium contents of gelatins and the gelatin derivatives applicable to the invention should be adjusted to be 1 to 999 ppm per gelatin by removing them through an ion-exchange filter.

It is preferred that the backing layers and backing protective layers each containing gelatin or the gelatin derivatives should be cross-linked with not only the forgoing epoxy cross-linking agents and peptide reagent but also either one of the following aldehyde hardeners:

(B-1) Formaldehyde, (B-2) Glyoxal, (B-3) Mucochloric acid, and the following vinyl sulfone type cross-linking agents:

(B-4) $CH_2=CH-SO_2-CH_2-O-CH_2-SO_2-CH=CH_2$, (B-5) $CH_2=CH-SO_2-CH_2CH_2CH_2SO_2-CH=CH_2$, (B-6) $CH_2=CH-SO_2-CH_2CH(OH)CH_2-SO_2-CH=CH_2$ and the following aziridine cross-linking agents including, for example, (B-7) 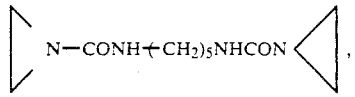

(B-8) 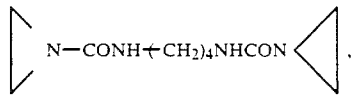

(B-9) 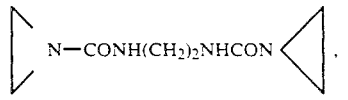

When controlling the cross-linked gelatin layers to have a swelling degree of 100 to 200%, more excellent results can be obtained.

It is preferable that the layers containing the backing dyes should be coated by making use of a coating solution comprising NaOH, KOH, $K_2CO_3$, $Na_2CO_3$, $NaHCO_3$, citric acid, oxalic acid, $H_3BO_4$ and $H_3PO_4$ after the pH is adjusted to be within the range of pH 4 to 8 and, particularly, pH 5 to 7. It is also preferable in this instance that the viscosity of the coating solution should be between 1 and 100 cp. The viscosity thereof may be adjusted to be within this range by adjusting the amounts of gelatin or electric conductive polymers. When occasion requires, it may be adjusted by the temperatures or pH values.

As for the matting agents applicable to the layers, methyl polymethacrylate or silica ($SiO_2$) may preferably be used. The average particle-size thereof may be selected from any particle-sizes of 0.1 to 10 μm. Silica matting agent may be used as the surfaces remain untreated. However, the silica matting agents be surface-treated with an inorganic or organic compounds. How to treat them may be referred to the techniques having been known by the skilled in the art as the surface treatments of silica compounds.

As for the developing agents applicable to the development of a silver halide photographic light-sensitive material relating to the invention, the following examples may be given. The typical examples of HO—(CH=CH)n—OH type developing agents include hydroquinone and, besides, catechol, pyrogallol and the derivatives thereof, ascorbic acid, chlorohydroquinone, bromohydroquinone, methylhydroquinone, 2,3-dibromohydroquinone, 2,5-diethylhydroquinone, 4-chlorocatechol, 4-phenyl-catechol, 3-methoxy-catechol, 4-acetylpyrogallol and sodium ascorbate.

HO—(CH=CH)n—$NH_2$ type developers include, for example, 4-aminophenol, 2-amino-6-phenylphenol, 2-amino-4-chloro-6-phenylphenol, N-methyl-p-aminophenol and, more typically, ortho- and para-aminophenol.

$H_2N$—(CH=CH)n—$NH_2$ type developers include, for example, 4-amino-2-methyl-N,N-diethylaniline, 2,4-diamino-N,N-diethylaniline, N-(4-amino-3-methylphenyl)-morpholine, p-phenylenediamine.

Heterocyclic type developers include, for example, 3-pyrazolidones such as 1-phenyl-3-pyrazolidone, 1-phenyl-4,4-dimethyl-3-pyrazolidone and 1-phenyl-4-methyl-4-hydroxymethyl-3-pyrazolidone, 1-phenyl-4-amino-5-pyrazolone, and 5-aminouracil.

Besides the above-given developers, there are the developers effectively applicable to the invention, such as those described in, for example, T. H. James, 'The Theory of the Photographic Process', 4th ed., pp. 291–334, and 'Journal of the American chemical Society' Vol. 73, p.3,100, (1951).

These developing agents may be used independently or in combination. However, they are preferably used in combination. If using a sulfite such as sodium sulfite or potassium sulfite as a preservative in developers applicable for developing a light-sensitive material relating to the invention, the effects of the invention may not be damaged. Besides, hydroxylamine or a hydrazide compound may also be used as a preservative and, in this instance, such a compound may be used in an amount of 5 to 500 g per liter of a developer and, more preferably, 20 to 200 g.

It is also permitted to contain glycols as an organic solvent in a developer. Such glycols include, for example, ethylene glycol, diethylene glycol, propylene glycol, triethylene glycol, 1,4-butanediol and 1,5-pentanediol. Among them, diethylene glycol should preferably be used. These organic solvents may be used in an amount of, preferably, 5 to 500 g per liter of a developer used and, more preferably, 20 to 200 g. These solvents may be used independently or in combination.

Silver halide photographic light-sensitive materials relating to the invention can have excellent preservation stability when they are developed with a developer containing such a development inhibitor as described above.

Of the developers having the above-described composition, the pH values are, preferably, within the range of 9 to 13 and, more preferably, 10 to 12 from the viewpoints of the preservability and photographic characteristics. About the cations of a developer, the higher a potassium ion content is than that of sodium ion, the more the developer may preferably be used, because the activity of the developer can be enhanced.

In the processing of light-sensitive materials of the invention, it is preferable that a fixer used therein contains a chelating agent. An EDTA type chelating agent may be used in the invention.

Silver halide photographic light-sensitive materials relating to the invention may be processed in various conditions. They may be processed at a temperature of, preferably, not higher than 50° C. and, more preferably, about 25° C. to 50° C. The development is completed generally within 2 minutes and preferably within the range of 5 to 50 seconds for which good results may often be obtained. Besides the developing step, it is optional to carry out, for example, a washing, stopping, stabilizing, fixing and, if required, prehardening and neutralizing steps, and these processing steps may appropriately be omitted. Further, these processing steps may be carried out in the so-called hand processing such as a tray- or frame-processing or the so-called mechanical processing such as a roller- or hanger-processing.

The characteristics of the light-sensitive materials of the invention are evaluated through processing and, therefore, such characteristics may be obtained through the four processing steps, namely, developing, fixing, washing and drying steps. Accordingly, these four successive processing steps may be called collectively a photographic process. A photographic light-sensitive materials contain various kinds of low and high molecular additives, and the low molecular components thereof are varied between before and after photographic processing, because some of the low molecular components may be eluted in the photographic process. It was found that the effects of the invention greatly depend on how to control these components. Through this knowledge, it also became clear that desirable results can be obtained by regulating the weight variations of a conductive layer, which are caused during the photographic process, to be within ±20% per volume of the conductive layer. Further, if the weight variations of a backing layer is within the range of 1 to 50%, the preferable results can be obtained without damaging the characteristics of the invention.

EXAMPLES

<Preparation of support with conductive layer>

A sheet of 100 μm-thick polyethyleneterephthalate film was used as a support. After by-axial stretching and heat-setting it, the surfaces of the sapport were treated with, a corona-discharge with 25 w/m$^2$min and subbed with a latex subbing solution.

After the subbing, another corona-discharge treatment was applied again with the same energy. The conductive polymer (shown in Table-1) each of the invention and a latex of butyl acrylate/styrene/divinylbenzene/acrylic acid=60/25/10/5 copolymer were mixed up in a ratio of 1:1, and the mixture was adjusted to pH4 and coated on the side of the support opposite to the side to be coated with a silver halide emulsion at 75° C. to form a conductive layer having the thickness of 0.5 μm and dried for 60 seconds.

A corona-discharge treatment with the energy strength of 25 w/m$^2$min. was applied onto the conductive layer.

<Backing layer>

A backing solution was prepared and coated on the conductive lay of the support so that the composition of the backing layer was made as described below.

| | |
|---|---|
| Hydroquinone | 100 mg/m$^2$ |
| Phenidone | 30 mg/m$^2$ |
| Latex polymer: butyl acrylate/styrene copolymer | 0.5 mg/m$^2$ |
| Polymer of the invention | See Table-1 |
| Styrene/maleic acid copolymer | 100 mg/m$^2$ |
| Citric acid | 40 mg/m$^2$ |
| Saponin | 200 mg/m$^2$ |
| Benzotriazole | 100 mg/m$^2$ |
| Lithium nitrate | 30 mg/m$^2$ |
| Ossein gelatin (calcium content: 100 ppm) | 2.0 g/m$^2$ |
| Backing dye | |

-continued (a) 40 mg/m²

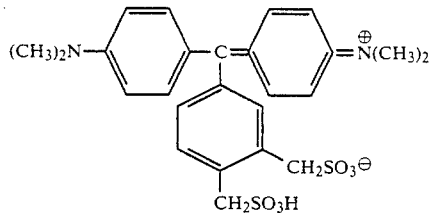

(b) 30 mg/m²

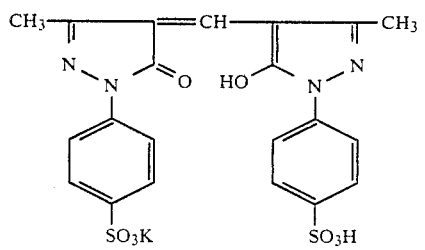

(c) 30 mg/m²

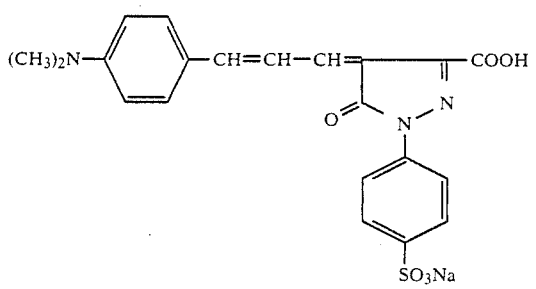

(d) 30 mg/m²

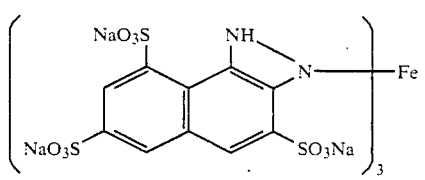

(Protective coat of backing layer)

A protective layer of backing layer was coated on the backing layer so that the composition of the protective layer was made as follows:

| | |
|---|---|
| Dioctyl sulfosuccinate | 300 mg/m² |
| Matting agent: polymethyl methacrylate (having an average particle-size: 4.0 μm) | 100 mg/m² |
| Colloidal silica | 30 mg/m² |
| Sodium polystyrenesuifonate ($\overline{M}$ 200,000) | 30 mg/m² |
| Ossein gelatin (having an isoelectric point: 4.9) | 1.1 g/m² |
| Sodium fluorsdodecylbenzenesulfonate | 50 mg/m² |

<Preparation of silver halide emulsion>

In an acidic atmosphere of pH 3.0 and in a controlled double-jet method, there prepared monodispersed silver halide composed grains which contain rhodium in an amount of $10^{-5}$ mols per mol of silver used. The grains were grown in a system containing benzyl adenine in an amount of 30 mg per liter of an aqueous 1% gelatin solution. After silver salt was mixed with halides, 6-methyl-4-hydroxy-1,3,3a,7-tetrazaindene was added in an amount of 600 mg per mol of silver halides used and the mixture was then washed and desalted.

Next, after 6-methyl-4-hydroxy-1,3,3a,7-tetrazaindene was added in an amount of 60 mg per mol of silver halides used, the mixture was then sulfur-sensitized. After then, 6-methyl-4-hydroxy-1,3,3a,7-tetrazaindene was added as a stabilizer.

(Silver halide emulsion layer)

After the following additives were added into each of the emulsions so as to adjust the undermentioned amounts added, the resulting emulsions were coated on the side of the above-mentioned support opposite to the backing side in the same manner as in Example-1 disclosed in Japanese Patent O.P.I. Publication No. 59-19941(1984).

| | |
|---|---|
| Latex of Styrene/butyl acrylate/acrylic acid three-components copolymer | 1.0 g/m² |
| Tetraphenylphosphonium chloride | 30 mg/m² |
| Saponin | 200 mg/m² |
| Potassium bromide | 10 mg/m² |
| Promethazine chloride | 7 mg/m² |
| Tyramide (medicine) | 5 mg/m² |
| Polyethylene glycol | 100 mg/m² |
| Sodium dodecylbenzene sulfonate | 100 mg/m² |
| Polyacryl amide | 100 mg/m² |
| Hydroquinone | 200 mg/m² |
| Phenidone | 100 mg/m² |
| Styrene/maleic acid polymer | 200 mg/m² |
| Butyl gallate | 500 mg/m² |
| Hydrazine compound H-53 | 200 mg/m² |
| 5-methylbenzotriazole | 30 mg/m² |

-continued

| | |
|---|---|
| 2-mercaptobenzimidazole-5-sulfonic acid | 30 mg/m$^2$ |
| Inert ossein gelatin (isoelectric point: 4.9) | 1.5 g/m$^2$ |
| 1-(p-acetylamidophenyl)-5-mercaptotetrazole | 30 mg/m$^2$ |
| Silver halide emulsion in terms of silver | 2.8 g/m$^2$ |

(Protective layer of emulsion layers)

A protective layer was prepared and coated on the emulsion layers so that the compositions of the layer was made as follows:

| | |
|---|---|
| Fluorinated dioctylsulfosuccinic acid ester | 300 mg/m$^2$ |
| Matting agent: methyl polymethacrylate (having an average particle-size: 3.5 μm) | 100 mg/m$^2$ |
| Lithium nitrate | 30 mg/m$^2$ |
| Acid-treated gelatin (having an isoelectric point: 7.0) | 1.2 g/m$^2$ |
| Colloidal silica | 50 mg/m$^2$ |
| Styrene/maleic acid copolymer | 100 mg/m$^2$ |
| Styrene/butyl acrylate/acrylic acid copolymer | 100 mg/m$^2$ |
| The following dye $D_1$ | 50 mg/m$^2$ |
| The following dye $D_2$ | 50 mg/m$^2$ |
| Mordant | 50 mg/m$^2$ |

$D_1$

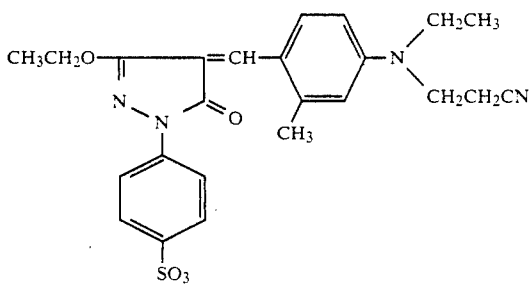

$D_2$

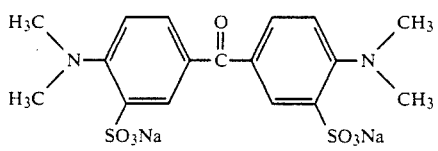

Mordant

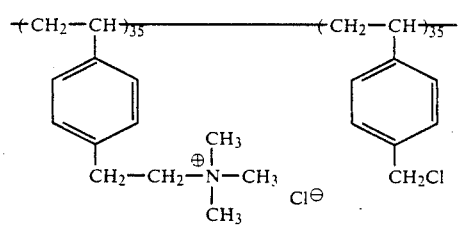

The resulting samples were exposed to light and processed with the following developer and fixer.

(Method of exposure)

A non-electrode discharged light-source having a maximum specific energy in the region of 400 to 420 nm, which is called a 'V-bulb' manufactured by Fusion Co. in the U.S.A., was attached underneath a glass plate. After an original document and a light-sensitive material were so placed on the glass plate as to evaluate reverse text qualities, they were exposed to light.

| <Formula of developer> | |
|---|---|
| Hydroquinone | 25 g |
| 1-phenyl-4,4-dimethyl-3-pyrazolidone | 0.4 g |
| N-methyl-p-aminophenol | 600 mg |
| Sodium bromide | 3 g |
| 5-methylbenzotriazole | 0.3 g |
| 5-nitroindazole | 0.05 g |
| Diethylaminopropane-1,2-diol | 10 g |

-continued

| | |
|---|---|
| Potassium sulfite | 90 g |
| Sodium 5-sulfosalicylate | 25 g |
| Sodium ethylenediaminetetraacetate | 2 g |
| Add water to make | 1 liter |
| Adjust pH with caustic soda to be | pH 11.5 |

| <Formula of fixer> | |
|---|---|
| (Composition A) | |
| Ammonium thiosulfate (in an aqueous 72.5% solution) | 240 ml |
| Sodium sulfite | 17 g |
| Ethylenediaminetetraacetic acid | 1 g |
| Sodium acetate trihydrate | 6.5 g |
| Boric acid | 6 g |
| Sodium citrate dihydrate | 2 g |
| Acetic acid (in an aqueous 90 w % solution) | 13.6 ml |
| (Composition B) | |
| Pure water (ion-exchange water) | 17 ml |
| Aluminium sulfate (in an aqueous solution having a reduced $Al_2O_3$ content of 8.1 w %) | 20 g |

When using the fixer, the above Compositions A and B were dissolved in order in 500 ml of water to make it 1 liter. The pH of the fixer was adjusted with sulfuric acid to be pH 6.0.

| <Development conditions> | | |
|---|---|---|
| (Processing step) | (Temperature) | (time) |
| Developing | 42° C. | 8.5 sec. |
| Fixing | 35° C. | 10 sec. |

-continued

| <Development conditions> | | |
|---|---|---|
| (Processing step) | (Temperature) | (time) |
| Washing | at ordinary temp. | 10 sec. |
| Drying | 50° C. | 10 sec. |

The evaluations were made as follows. The results thereof are shown in Table-1.

(Method of evaluating characteristics)

(1) Pin-hole improvement characteristics

A halftone film was placed on a pasting-up base and the circumference of the halftone film was fixed with a trans parent Scotch Tape for graphic arts use. After exposing the film to light and processing it, the resulting pin-holes were evaluated by 5 grades. When there was no pin-hole found, it graded 5. When there were the most found on an inferior level, it graded 1.

(2) Scratch resistance

The evaluations were made with a scratch resistance tester. To be more concrete, a test piece was scratched thereon with a sapphire stylus with a globular tip having a diameter of 0.25 mm at a speed of 1 cm/sec with applying a load, and the resulting scratches were evaluated. When testing, the test piece was heat-treated at 40° C. for 6 hours after it was coated and dried. The scratched conditions were evaluated by eye. When the scratches were on the worst level, it graded 1. When the scratches were on the best level, it graded 5.

(3) Static charge

A test piece before processing was placed on a glass plate and was then scrubbed with a rubber-made roller for printer use.

The test piece was made 2-cm closer over to a flat plate having put thereon with a large number of 2-mm square-sized small bits of paper on a flat plate. Then, the electric charges were observed by 5 grades in the manner that the number of the paper bits attracted to the test piece were counted. When no paper bit was attracted at all, it evaluated as grade 5, and when the bits of paper were attracted most, it evaluated as grade 1.

TABLE 1

| Sample No. | Conductive polymer Comp. No. | Conductive polymer g/m² | Cross-linking agent Comp. No. | Cross-linking agent mg/m² | Swelling degree % |
|---|---|---|---|---|---|
| 1 | — | — | — | — | — |
| 2 | 4 | 1.0 | A-2 | 2 | 500 |
| 3 | 4 | 1.0 | A-2 | 10 | 400 |
| 4 | 4 | 1.0 | A-2 | 50 | 250 |
| 5 | 4 | 1.0 | A-2 | 100 | 150 |
| 6 | 4 | 1.0 | A-2 | 200 | 100 |
| 7 | 6 | 1.0 | A-3 | 120 | 90 |
| 8 | 7 | 1.2 | A-4 | 150 | 120 |
| 9 | 8 | 0.9 | A-5 | 130 | 130 |
| 10 | 12 | 0.8 | A-6 | 160 | 140 |
| 11 | 12 | 1.0 | a | 160 | 450 |
| 12 | 12 | 1.0 | b | 50 | 500 |
| 13 | 12 | 1.0 | c | 30 | 600 |

Comparative cross-linking agent a 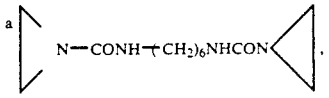

b 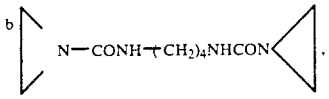

c OHC—CHO

Thus obtained results are shown in Table 2.

TABLE 2

| Sample No. | Evaluated characteristics: Pin-hole | Scratch resistance | Static change | Note |
|---|---|---|---|---|
| 1 | 1 | 1 | 1 | Comparative |
| 2 | 1 | 2 | 1 | Comparative |
| 3 | 4 | 3 | 3 | Inventive |
| 4 | 4 | 4 | 4 | Inventive |
| 5 | 5 | 5 | 5 | Inventive |
| 6 | 4 | 5 | 4 | Inventive |
| 7 | 4 | 5 | 4 | Inventive |
| 8 | 3 | 4 | 3 | Inventive |
| 9 | 3 | 4 | 3 | Inventive |
| 10 | 3 | 4 | 3 | Inventive |
| 11 | 1 | 2 | 2 | Comparative |
| 12 | 1 | 2 | 2 | Comparative |
| 13 | 1 | 2 | 1 | Comparative |

From the results shown in Table-2, it is apparent that Samples No. 3 through No. 10 each relating to the constitution of the invention are excellent in static charge, less in pin-hole production, excellent in scratch resistance.

What is claimed is:

1. A silver halide photographic light sensitive material comprising a support and a plurality of layers on a surface thereof, said layers comprising:

an electric conductive layer consisting essentially of a latex and of an olefinic polymer having a molecular weight of from about 1,000 to about 1,000,000 and having a substantial proportion of monomeric units with an aromatic ring substituent or a heterocyclic ring substituent, wherein said ring substituent has a sulfonic acid group or a salt thereof bound directly to the ring of said ring substituent or bound through a divalent group, and wherein said electric conductive layer is crosslinked with a crosslinking agent having an epoxy group to make the swelling degree of said electric conductive layer be within the range of about 0.2% to about 300%; and a silver halide emulsion layer.

2. The material of claim 1, wherein said aromatic ring substituent contained in said polymer is a benzene ring.

3. The material of claim 1, wherein said heterocyclic ring substituent contained in said polymer is a pyridine ring.

4. The material of claim 1 wherein said olefinic polymer has a molecular weight of from 10,000 to 500,000.

5. The material of claim 1, wherein said electric conductive layer contains 0.001 g/m² to 10 g/m² of said olefinic polymer.

6. The material of claim 5, wherein said electric conductive layer contains 0.05 g/m² to 5 g/m² of said olefinic polymer.

7. The material of claim 1, wherein said latex comprises particles of a polymer of an acrylate or a methacrylate of an alkyl group having 2 to 6 carbon atoms.

8. The material of claim 1, wherein said electric conductive layer has a swelling degree of from 20 to 200%.

9. The material of claim 1, wherein said electric conductive layer has a thickness of from 0.1 μm to 100 μm.

10. The material of claim 9, wherein said electric conductive layer has a thickness of from 0.1 μm to 10 μm.

11. The material of claim 1, wherein the surface of said electric conductive layer is activated by application of corona discharge with an energy of from 1 mW/m² to 1KW/m².

12. The material of claim 1, wherein said electric conductive layer is provided on a surface of said support opposite to the surface on which said silver halide emulsion layer is provided and a backing layer is provided on said electric conductive layer.

* * * * *